US011765534B2

(12) United States Patent
Wu et al.

(10) Patent No.: US 11,765,534 B2
(45) Date of Patent: Sep. 19, 2023

(54) CAPACITIVE MICROPHONE WITH TWO SIGNAL OUTPUTS THAT ARE ADDITIVE INVERSE OF EACH OTHER

(71) Applicants: Guanghua Wu, Dublin, CA (US); Xingshuo Lan, San Jose, CA (US); Zhixiong Xiao, Fremont, CA (US)

(72) Inventors: Guanghua Wu, Dublin, CA (US); Xingshuo Lan, San Jose, CA (US); Zhixiong Xiao, Fremont, CA (US)

(73) Assignee: GMEMS TECH SHENZHEN LIMITED, Shenzhen (CN)

( * ) Notice: Subject to any disclaimer, the term of this patent is extended or adjusted under 35 U.S.C. 154(b) by 341 days.

(21) Appl. No.: 17/120,170

(22) Filed: Dec. 13, 2020

(65) Prior Publication Data

US 2021/0099823 A1 Apr. 1, 2021

Related U.S. Application Data

(60) Continuation-in-part of application No. 17/008,638, filed on Sep. 1, 2020, which is a division of application No. 15/730,732, filed on Oct. 12, 2017, now Pat. No. 10,798,508, which is a continuation-in-part of application No. 15/623,339, filed on Jun. 14, 2017, now Pat. No. 10,244,330, which is a continuation-in-part of application No. 15/393,831, filed on Dec. 29, 2016, now Pat. No. 10,171,917.

(51) Int. Cl.
*H04R 19/04* (2006.01)
*H04R 31/00* (2006.01)

(52) U.S. Cl.
CPC ..... *H04R 31/00* (2013.01); *H04R 19/04* (2013.01); *H04R 2201/003* (2013.01); *H04R 2410/03* (2013.01)

(58) Field of Classification Search
CPC ..... H04R 19/04; H04R 19/005; H04R 2201/003; H04R 2410/03; H04R 31/00; B81B 3/0021; B81C 1/00158; H02N 2/02
See application file for complete search history.

(56) References Cited

U.S. PATENT DOCUMENTS 4,403,163 A * 9/1983 Armerding ..... H02K 3/40 310/201
10,273,150 B2 * 4/2019 Sun ..... H04R 31/00
2003/0094047 A1 * 5/2003 Torkkeli ..... G01L 9/0073 73/716
2007/0284682 A1 * 12/2007 Laming ..... H04R 19/005 257/E21.526

(Continued)

*Primary Examiner* — S M Sohel Imtiaz
(74) *Attorney, Agent, or Firm* — George Guosheng Wang; Upstream Research and Patent LLC

(57) ABSTRACT

The present invention provides a capacitive microphone such as a MEMS microphone with two capacitors. The signal output from the first capacitor is additive inverse of that from the second capacitor, and a total signal output is a difference between the two outputs. In at least one of the two capacitors, a movable or deflectable membrane/diaphragm moves in a lateral manner relative to the fixed capacitor plate, instead of moving toward/from the fixed plate. The squeeze film damping, and the noise are substantially avoided, and the performances of the microphone is significantly improved.

14 Claims, 36 Drawing Sheets

(56) References Cited

U.S. PATENT DOCUMENTS

2008/0226217 A1* 9/2008 Kilic ..... G01H 9/004 385/12
2008/0247573 A1* 10/2008 Pedersen ..... H04R 19/005 381/174
2012/0213400 A1* 8/2012 Kasai ..... H04R 19/04 381/369
2014/0264662 A1* 9/2014 Cheng ..... B81B 7/02 257/419
2015/0274506 A1* 10/2015 Feyh ..... B81C 1/00301 257/416
2016/0037266 A1* 2/2016 Uchida ..... H04R 7/06 381/174
2016/0130137 A1* 5/2016 Huang ..... B81B 7/02 438/51
2016/0167946 A1* 6/2016 Jenkins ..... H04R 19/005 257/416
2017/0166437 A1* 6/2017 Klein ..... H04R 19/005
2017/0265009 A1* 9/2017 Sridharan ..... H04R 7/26
2018/0086624 A1* 3/2018 Cheng ..... B81B 3/007
2018/0359571 A1* 12/2018 Zhan ..... B81C 1/00158

* cited by examiner

Cross Section View

Top View (a)

(b)

CAPACITIVE MICROPHONE WITH TWO SIGNAL OUTPUTS THAT ARE ADDITIVE INVERSE OF EACH OTHER

CROSS-REFERENCE TO RELATED U.S. APPLICATIONS

This application is Continuation-in-Part of U.S. non-provisional application Ser. No. 17/008,638 filed on Sep. 1, 2020, which is a divisional application of U.S. Ser. No. 15/730,732 filed on Oct. 12, 2017 (now U.S. Pat. No. 10,798,508 issued on Oct. 6, 2020), which is a Continuation-in-Part of U.S. non-provisional application Ser. No. 15/623,339 filed on Jun. 14, 2017 (now U.S. Pat. No. 10,244,330 issued on Mar. 26, 2019), which is Continuation-in-Part of U.S. non-provisional application Ser. No. 15/393,831 filed on Dec. 29, 2016 (now U.S. Pat. No. 10,171,917 issued on Jan. 1, 2019), all of which are incorporated herein by reference in their entirety.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

FIELD OF THE INVENTION

The present invention generally relates to a lateral mode capacitive microphone with a total signal output generated from two signal outputs, one of which is an additive inverse of another. The microphone of the invention may find applications in smart phones, telephones, healing aids, public address systems for concert halls and public events, motion picture production, live and recorded audio engineering, two-way radios, megaphones, radio and television broadcasting, and in computers for recording voice, speech recognition, VoIP, and for non-acoustic purposes such as ultrasonic sensors or knock sensors, among others.

BACKGROUND OF THE INVENTION

A microphone is a transducer that converts sound into an electrical signal. Among different designs of microphone, a capacitive microphone or a condenser microphone is conventionally constructed employing the so-called "parallel-plate" capacitive design. Unlike other microphone types that require the sound wave to do more work, only a small mass in capacitive microphones needs be moved by the incident sound wave. Capacitive microphones generally produce a high-quality audio signal, and they are now the popular choice in consumer electronics, laboratory and recording studio applications, ranging from telephone transmitters through inexpensive karaoke microphones to high-fidelity recording microphones.

FIG. 1A is a schematic diagram of parallel capacitive microphone in the prior art. Two thin layers 101 and 102 are placed closely in almost parallel One of them is fixed backplate 101, and the other one is movable/deflectable membrane/diaphragm 102, which can be moved or driven by sound pressure. Diaphragm 102 acts as one plate of a capacitor, and the vibrations thereof produce changes in the distance between two layers 101 and 102, and changes in the mutual capacitance therebetween.

"Squeeze film" and "squeezed film" refer to a type of hydraulic or pneumatic damper for damping vibratory motion of a moving component with respect to a fixed component. Squeezed film damping occurs when the moving component is moving perpendicular and in close proximity to the surface of the fixed component (e.g., between approximately 2 and 50 micrometers) The squeezed film effect results from compressing and expanding the fluid (e.g., a gas or liquid) trapped in the space between the moving plate and the solid surface. The fluid has a high resistance, and it damps the motion of the moving component as the fluid flows through the space between the moving plate and the solid surface.

In capacitive microphones as shown in FIG. 1, squeeze film damping occurs when two layers 101 and 102 are in close proximity to each other with air disposed between them. The layers 101 and 102 are positioned so close together (e.g. within 5 μm) that air can be "squeezed" and "stretched" to slow movement of membrane/diaphragm 101. As the gap between layers 101 and 102 shrinks, air must flow out of that region. The flow viscosity of air, therefore, gives rise to a force that resists the motion of moving membrane/diaphragm 101. Squeeze film damping is significant when membrane/diaphragm 101 has a large surface area to gap length ratio. Such squeeze film damping between the two layers 101 and 102 becomes a mechanical noise source, which is the dominating factor among all noise sources in the entire microphone structure.

U.S. Pat. No. 10,171,917 to the same assignee teaches a novel microphone with a lateral mode design, in which the movable membrane/diaphragm does not move into the fixed backplate and the squeeze film damping is substantially avoided. Advantageously, the present invention provides an improved microphone design, in which the noise is further reduced.

SUMMARY OF THE INVENTION

The present invention provides capacitive microphone comprising a first capacitor and a second capacitor. A signal output S1 of the first capacitor is substantially (±5%) or exactly the additive inverse of a signal output S2 of the second capacitor. The total signal output St of the microphone is a difference between S1 and S2. The first capacitor comprises a first electrical conductor ECA1 and a second electrical conductor ECA2 that are configured in a lateral mode. By "later mode," it is intended to mean that conductors ECA1 and ECA2 have a mutual capacitance therebetween. The mutual capacitance can be varied by an acoustic pressure impacting upon ECA1 and/or ECA2 along a range of impacting directions in 3D space, generating the signal output S1 of the first capacitor. The mutual capacitance is varied the most by an acoustic pressure impacting upon ECA1 and/or ECA2 along one direction among the range of impacting directions, and the one direction is defined as the primary direction. ECA1 has a first projection along the primary direction on a conceptual plane that is perpendicular to the primary direction; and ECA2 has a second projection along the primary direction on the conceptual plane. The first projection and the second projection have a shortest distance Dmin therebetween, and Dmin remains greater than zero regardless of that ECA1 and/or ECA2 is (are) impacted by an acoustic pressure along the primary direction or not.

The above features and advantages and other features and advantages of the present invention are readily apparent from the following detailed description of the best modes for carrying out the invention when taken in connection with the accompanying drawings.

BRIEF DESCRIPTION OF THE SEVERAL VIEWS OF THE DRAWINGS

The present invention is illustrated by way of example, and not by way of limitation, in the figures of the accompanying drawings and in which like reference numerals refer to similar elements. All the figures are schematic and generally only show parts which are necessary in order to elucidate the invention. For simplicity and clarity of illustration, elements shown in the figures and discussed below have not necessarily been drawn to scale. Well-known structures and devices are shown in simplified form in order to avoid unnecessarily obscuring the present invention. Other parts may be omitted or merely suggested.

DETAILED DESCRIPTION OF THE PREFERRED EMBODIMENT

In the following description, for the purposes of explanation, numerous specific details are set forth in order to provide a thorough understanding of the present invention. It is apparent, however, to one skilled in the art that the present invention may be practiced without these specific details or with an equivalent arrangement.

Where a numerical range is disclosed herein, unless otherwise specified, such range is continuous, inclusive of both the minimum and maximum values of the range as well as every value between such minimum and maximum values. Still further, where a range refers to integers, only the integers from the minimum value to and including the maximum value of such range are included. In addition, where multiple ranges are provided to describe a feature or characteristic, such ranges can be combined.

It is also to be understood that the terminology used herein is for the purpose of describing particular embodiments only, and is not intended to limit the scope of the invention. For example, when an element is referred to as being "on", "connected to", or "coupled to" another element, it can be directly on, connected or coupled to the other element or intervening elements may be present. In contrast, when an element is referred to as being "directly on", "directly connected to" or "directly coupled to" another element, there are no intervening elements present.

Throughout the specification and claims, the following terms take the meanings explicitly associated herein, unless the context clearly dictates otherwise. The phrase "in one embodiment" does not necessarily refer to the same embodiment, although it may. Furthermore, the phrase "in another embodiment" does not necessarily refer to a different embodiment, although it may. Thus, as described below, various embodiments of the invention may be readily combined without departing from the scope or spirit of the invention.

In addition, as used herein, the term "or" is an inclusive "or" operator and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Figure 1A:
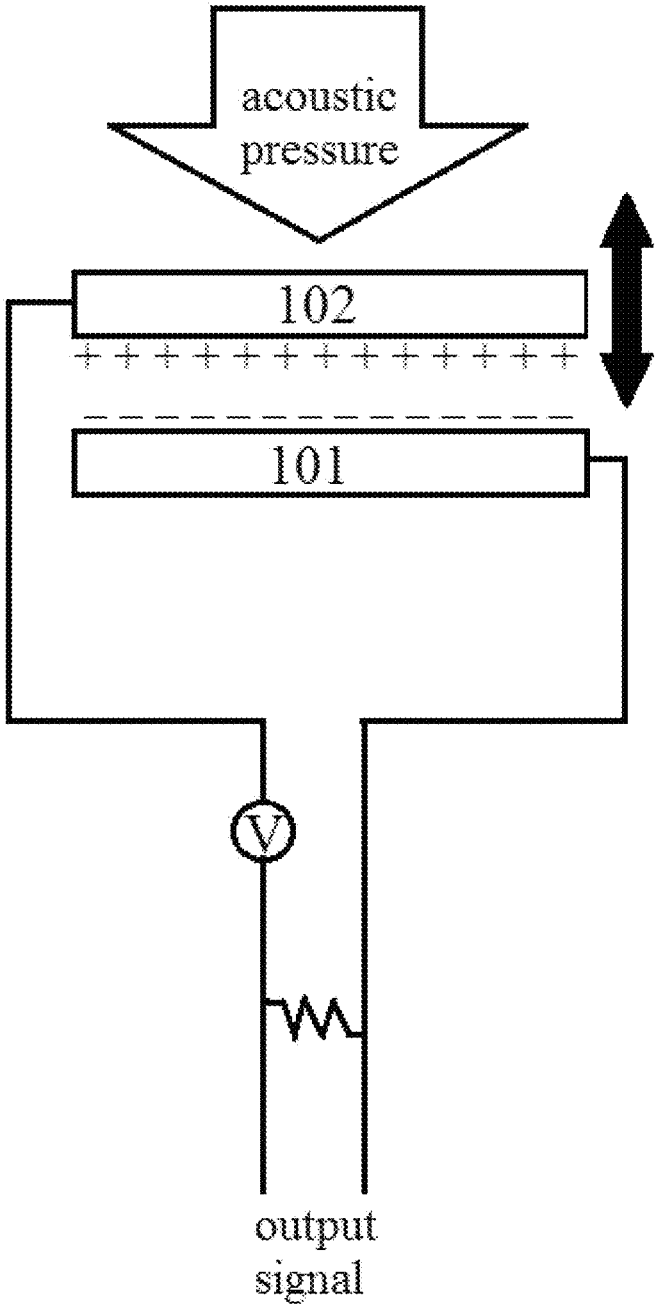
(Prior Art) Figure 1A
FIG. 1A shows a conventional capacitive microphone in the prior art.
Figure 1B:
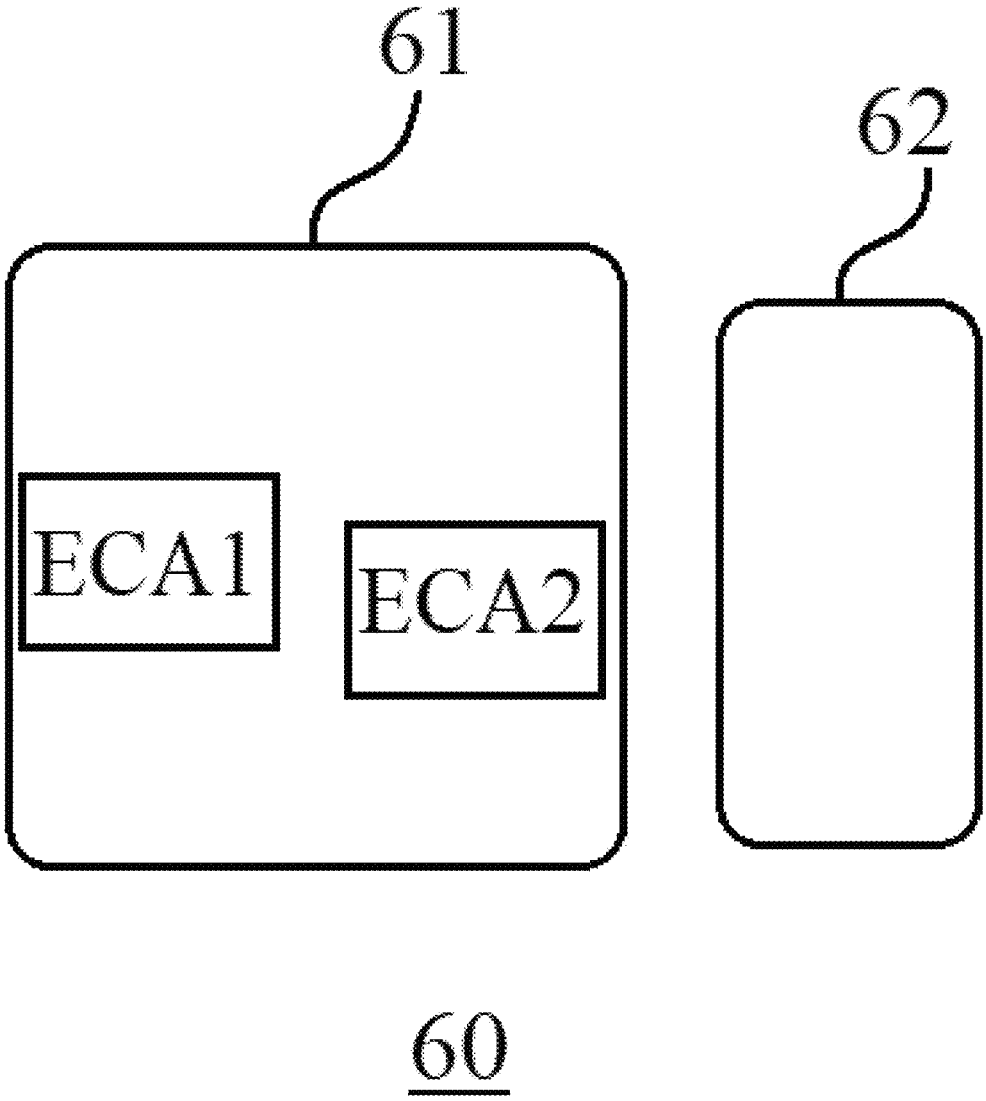
FIG. 1B schematically shows a capacitive microphone in accordance with an exemplary embodiment of the present invention that includes at least one pair of capacitor plates arranged in lateral mode configuration.

With reference to FIG. 1B, a capacitive microphone 60 includes a first capacitor 61 and a second capacitor 62. In mathematics, the additive inverse of a number a is the number that, when added to a, yields zero. This number is also known as the opposite (number), sign change, and negation. For example, the additive inverse of 7 is −7, because 7+(−7)=0. The additive inverse of −0.3 is 0.3, because (−0.3)+0.3=0. A signal output S1 of the first capacitor 61 is substantially the additive inverse of a signal output S2 of the second capacitor 62, with a deviation of less than ±20%, ±15%, ±10%, ±5%, ±3%, or ±1%. For example, when the deviation is less than ±10%, S1 will be equal to −(S2±10% S2), which is within a range of from −0.9×S2 to −1.1×S2. The total signal output St of the microphone 60 is a difference between S1 and S2. For example, St=7−(−7)=14 (unit), or St=(−7)−7=−14 (unit). In some embodiments, however, an acoustic and/or electronic noise N1 of the signal output S1 may not be the additive inverse of the counterpart noise N2 of the signal output S2. For example, N1 may be substantially the same as N2 with a deviation of less than ±20%, ±15%, ±10%, ±5%, ±3%, or ±1%, including N1=N2. Therefore, electronic noise N1 of the signal output S1 partially or completely cancels off noise N2 of the signal output S2, when the total signal output St is generated. For example, if N1=N2=+0.5, then St=S1−S2=(7+0.5)−(−7+0.5)=14 (unit), or St=S1−S2=(−7+0.5)−(7+0.5)=−14 (unit).

As shown in FIG. 1B, the first capacitor 61 comprises a first electrical conductor ECA1 and a second electrical conductor ECA2 that are configured in a lateral mode. By "later mode," it is intended to mean that conductors ECA1 and ECA2 have a mutual capacitance therebetween. The mutual capacitance can be varied by an acoustic pressure impacting upon ECA1 and/or ECA2 along a range of impacting directions in 3D space, generating the signal output S1 of the first capacitor. The mutual capacitance is varied the most by an acoustic pressure impacting upon ECA1 and/or ECA2 along one direction among the range of impacting directions, and the one direction is defined as the primary direction. ECA1 has a first projection along the primary direction on a conceptual plane that is perpendicular to the primary direction; and ECA2 has a second projection along the primary direction on the conceptual plane. The first projection and the second projection have a shortest distance Dmin therebetween, and Dmin remains greater than zero regardless of that ECA1 and/or ECA2 is (are) impacted by an acoustic pressure along the primary direction or not.

Figure 3:
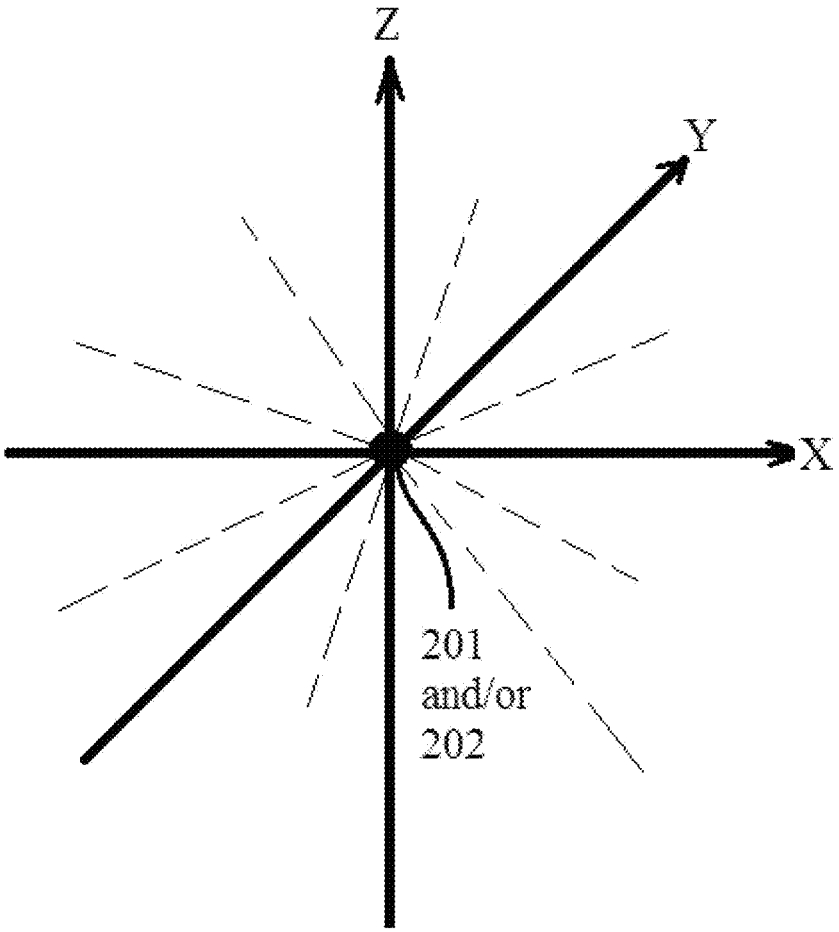
FIG. 3 illustrates acoustic pressures impacting a microphone along a range of directions.
Figure 4:
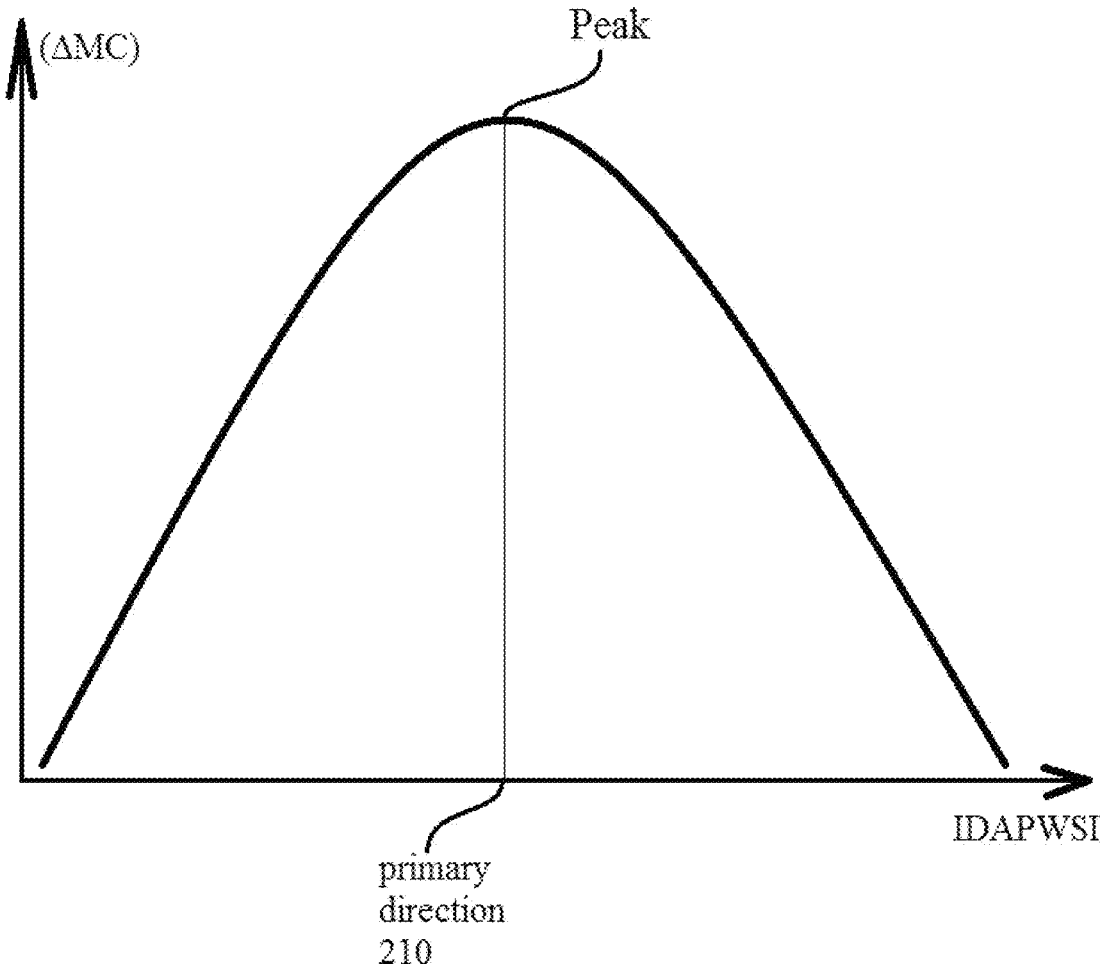
FIG. 4 illustrates the methodology on how to determine the primary direction for the internal components in a microphone in accordance with an exemplary embodiment of the present invention.

The term "lateral mode" will be explained in more details with reference to FIG. 2A. A first electrical conductor 201 (an embodiment of ECA1) and a second electrical conductor 202 (an embodiment of ECA2) in a capacitive microphone 200 such as a MEMS microphone are configured in a lateral mode. Conductor 201 and conductor 202 are configured to have a relative spatial relationship therebetween so that a mutual capacitance can be generated between them. The first electrical conductor 201 and the second electrical conductor 202 are independently of each other made of polysilicon, gold, silver, nickel, aluminum, copper, chromium, titanium, tungsten, and platinum. The relative spatial relationship as well as the mutual capacitance can both be varied by an acoustic pressure impacting upon the first electrical conductor 201 and/or the second electrical conductor 202. As shown in FIG. 3, the acoustic pressure may impact conductor 201 and/or conductor 202 along a range of impacting directions in 3D space as represented by dotted lines. Given the same strength/intensity of acoustic pressure, the mutual capacitance can be varied the most (or maximally varied) by an acoustic pressure impacting upon the first electrical conductor 201 and/or the second electrical conductor 202 along a certain direction among the above range of impacting directions as shown in FIG. 3. The variation of mutual capacitance (AMC) caused by various impacting directions of acoustic pressure from 3D space with same intensity (IDAPWSI) is conceptually plotted in FIG. 4. A primary direction is defined as the impacting direction that generates the peak value of AMC, and is labeled as direction 210 in FIG. 2A. It should be appreciated that, given the same strength/intensity of acoustic pressure, the relative spatial relationship can be varied the most (or maximally varied) by an acoustic pressure impacting upon the first electrical conductor 201 and/or the second electrical conductor 202 along a certain direction X among the range of impacting directions as shown in FIG. 3. Direction X may be the same as, or different from, the primary direction 210 as defined above. In some embodiments of the invention, the primary direction may be alternatively defined as the direction X.

Referring back to FIG. 2A, the first electrical conductor 201 has a first projection 201P along the primary direction 210 on a conceptual plane 220 that is perpendicular to the primary direction 210. The second electrical conductor 202 has a second projection 202P along the primary direction 210 on the conceptual plan 220*e*. The first projection 201P and the second projection 202P have a shortest distance Dmin therebetween. Dmin may be constant or variable, but it is always greater than zero, no matter the first electrical conductor 201 and/or the second electrical conductor 202 is (are) impacted by an acoustic pressure along the primary direction 210 or not. FIG. 2B illustrates an exemplary embodiment of the microphone of FIG. 2A. First electrical conductor 201 is stationary, and has a function similar to the fixed backplate in the prior art. A large flat area of second electrical conductor 202, similar to movable/deflectable membrane/diaphragm 102 in FIG. 1A, receives acoustic pressure and moves up and down along the primary direction, which is perpendicular to the flat area. However, conductors 201 and 202 are configured in a side-by-side spatial relationship. As one "plate" of the capacitor, second electrical conductor 202 does not move significantly toward and from first conductor 201. Instead, second conductor 202 moves laterally over, or "glides" over, first conductor 201, producing changes in the overlapped area between conductors 201 and 202, and therefore varying the mutual capacitance therebetween. A capacitive microphone based on such a relative movement between conductors 201 and 202 is called lateral mode capacitive microphone in the present invention.

Figure 2A:
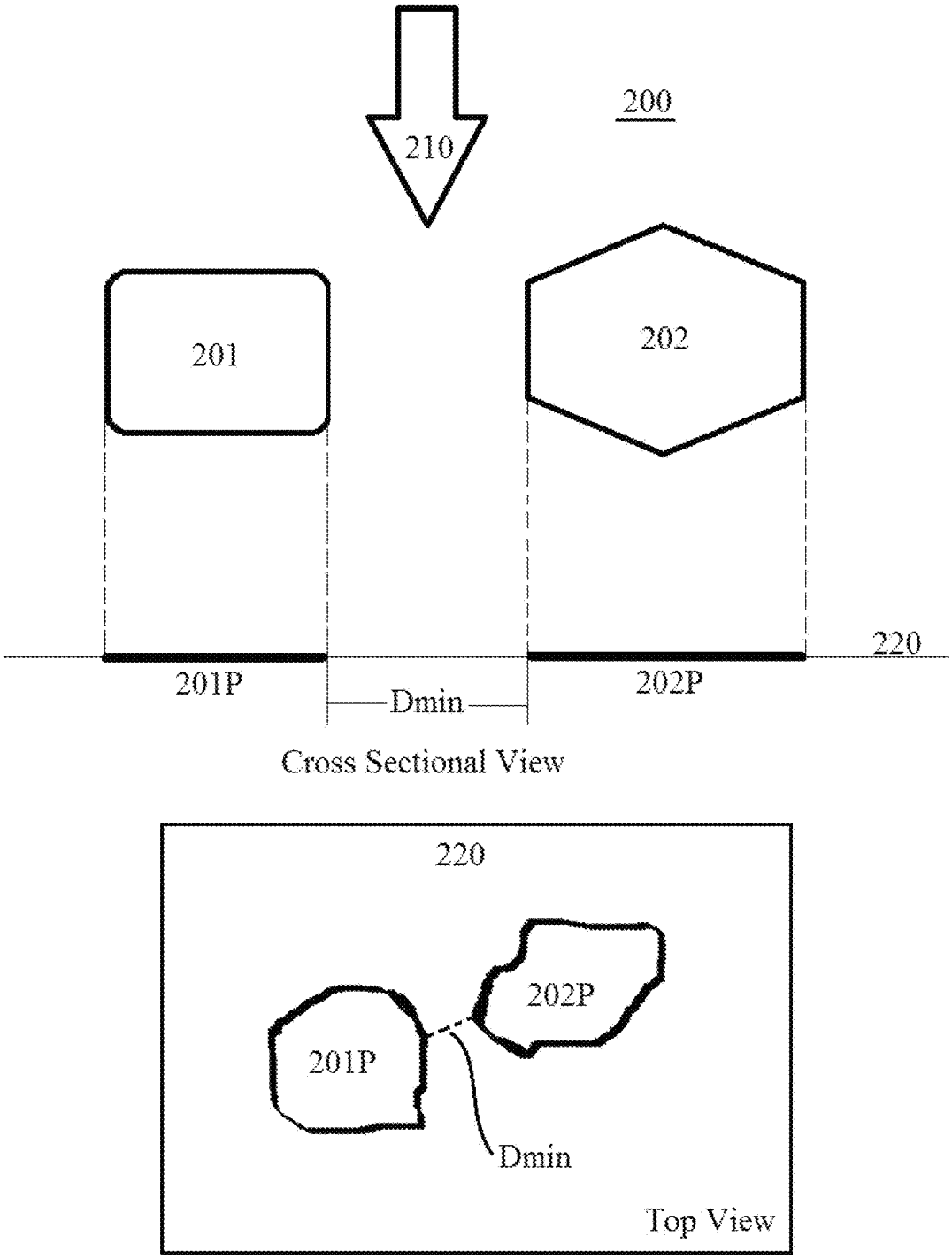
FIG. 2A illustrates the lateral mode configuration of capacitor plates in accordance with an exemplary embodiment of the present invention
Figure 2B:
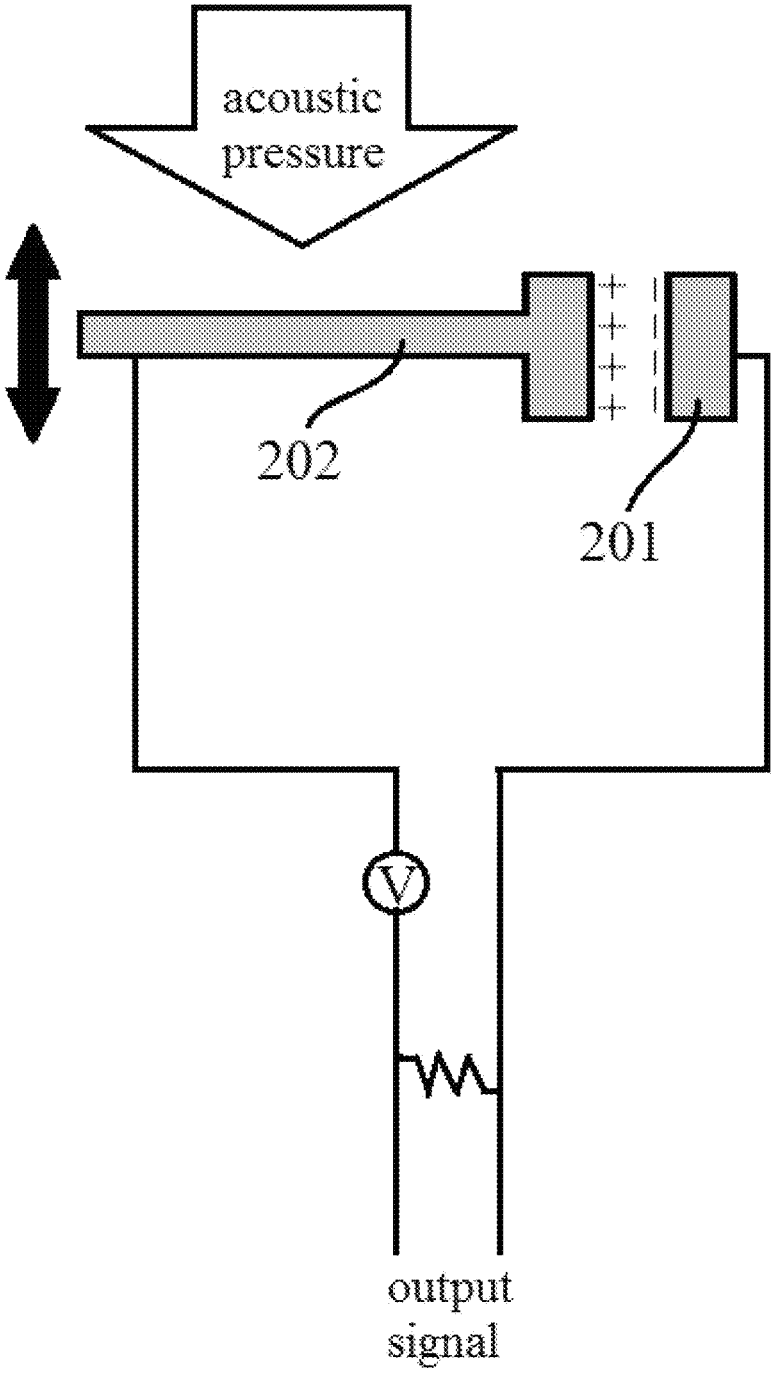
FIG. 2B illustrates the principle of a lateral mode capacitive microphone in accordance with an exemplary embodiment of the present invention.

In exemplary embodiments of the invention, the microphone 60 in FIG. 1B and/or microphone 200 in FIGS. 2A-2B may be a MEMS (Microelectromechanical System) microphone, AKA chip/silicon microphone. Typically, a pressure-sensitive diaphragm is etched directly into a silicon wafer by MEMS processing techniques, and is usually accompanied with integrated preamplifier. For a digital MEMS microphone, it may include built in analog-to-digital converter (ADC) circuits on the same CMOS chip making the chip a digital microphone and so more readily integrated with digital products.

Figure 5:
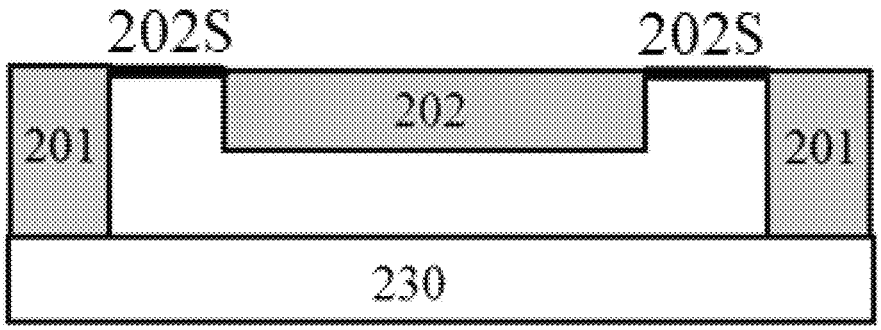
FIG. 5 schematically shows a MEMS capacitive microphone in accordance with an exemplary embodiment of the present invention.
Figure 5:
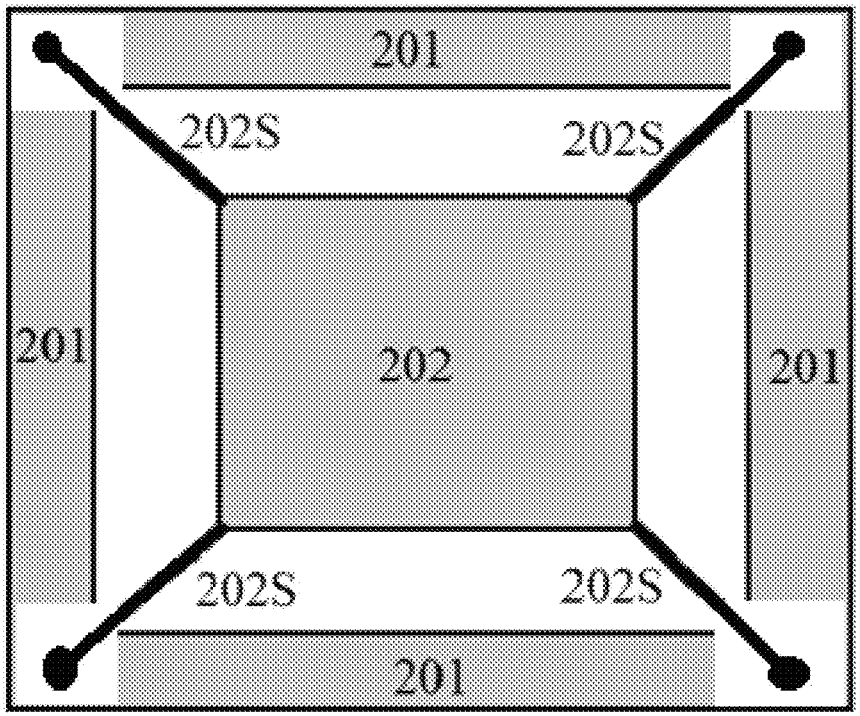

In an embodiment as shown in FIG. 5, capacitive microphone 60 or 200 may include a substrate 230 such as silicon. The substrate 230 can be viewed as the conceptual plane 220 in FIG. 2A. The first electrical conductor 201 and the second electrical conductor 202 may be constructed above the substrate 230 side-by-side. Alternatively, first electrical conductor 201 may be surrounding the second electrical conductor 202, as shown in FIG. 5. In an exemplary embodiment, first electrical conductor 201 is fixed relative to the substrate 230. On the other hand, second electrical conductor 202 may be a membrane that is movable relative to the substrate 230. The primary direction may be (is) perpendicular to the membrane plane 202. The movable membrane 202 may be attached to the substrate 230 via three or more suspensions 202S such as four suspensions 202S. As will be described and illustrated later, each of the suspension 202S may comprise folded and symmetrical cantilevers.

Figure 6:
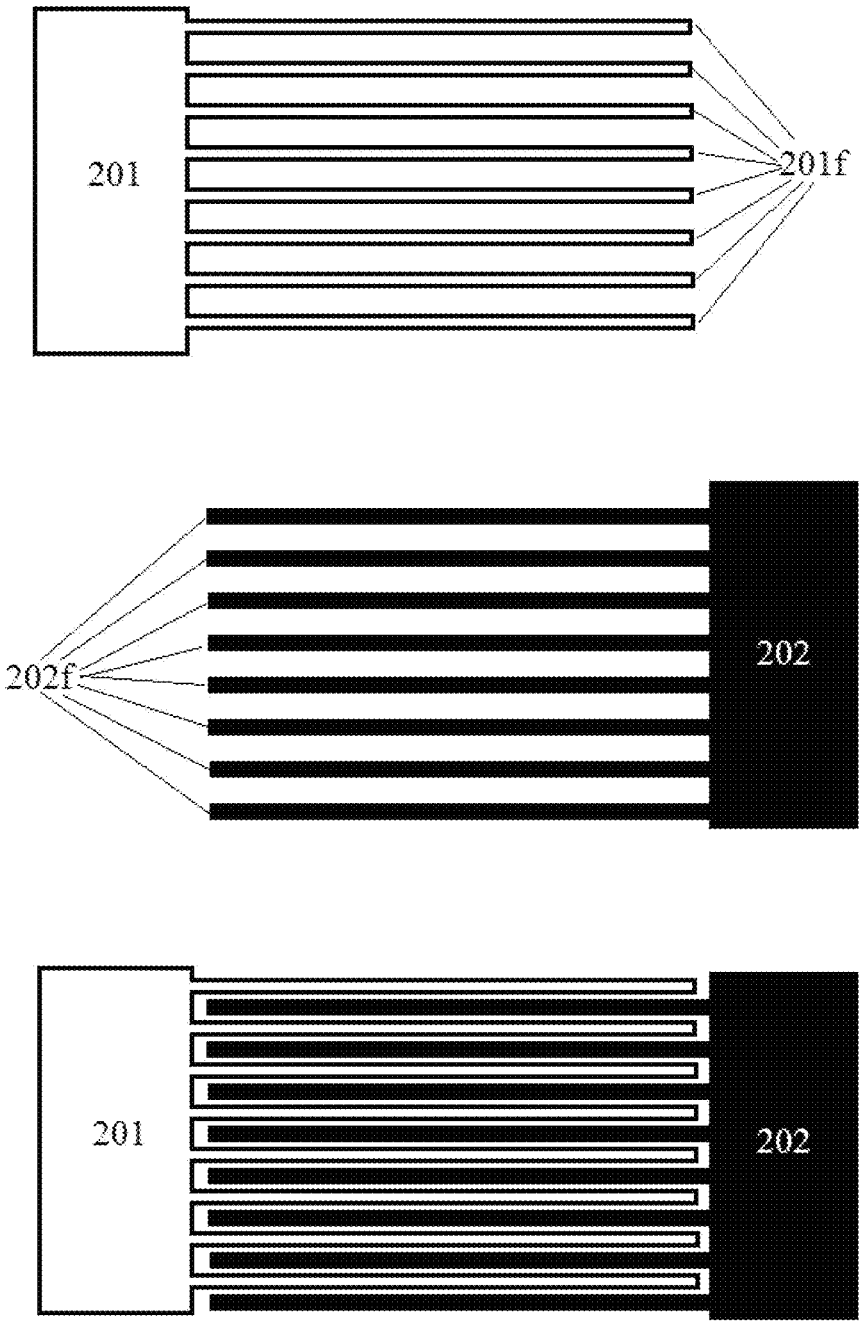
FIG. 6 illustrates the first/second electrical conductors having a comb finger configuration in accordance with an exemplary embodiment of the present invention.
Figure 7:
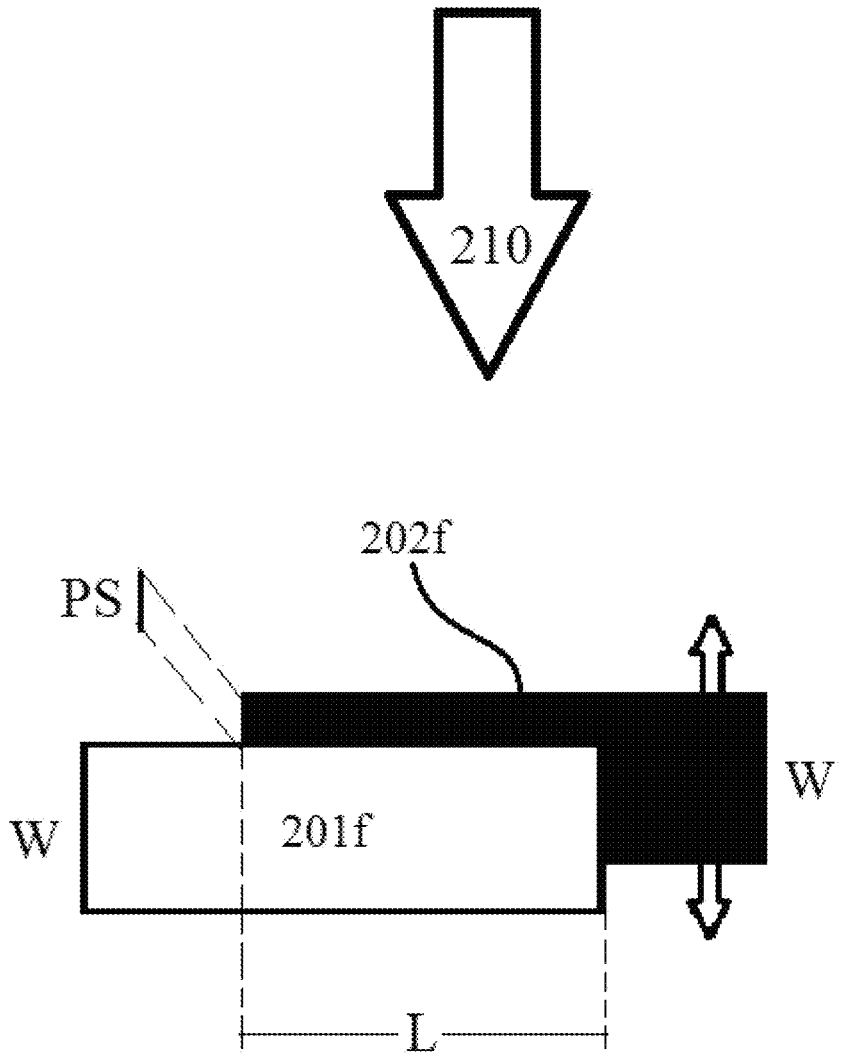
FIG. 7 depicts the spatial relationship between two comb fingers of FIG. 6 in accordance with an exemplary embodiment of the present invention.

In an embodiment as shown in FIG. 6, the first electrical conductor 201 comprises a first set of comb fingers 201*f*. The movable membrane as second conductor 202 comprises a second set of comb fingers 202*f* around the peripheral region of the membrane. The two sets of comb fingers 201*f* and 202*f* are interleaved into each other. The second set of comb fingers 202*f* are movable along the primary direction, which is perpendicular to the membrane plane 202, relative to the first set of comb fingers 201*f* As such, the resistance from air located within the gap between the membrane 202 and the substrate is lowered, for example, 25 times lower squeeze film damping. In a preferred embodiment, the first set of comb fingers 201*f* and the second set of comb fingers 202*f* have identical shape and dimension. As shown in FIG. 7, each comb finger has a same width W measured along the primary direction 210, and the first set of comb fingers 201*f* and the second set of comb fingers 202*f* have a positional shift PS along the primary direction 210, in the absence of vibration caused by sound wave. For example, the positional shift PS along the primary direction 210 may be one third of the width W, PS=1/3 W. In other words, the first set of comb fingers 201*f* and the second set of comb fingers 202*f* have an overlap of ⅔W along the primary direction 210, in the absence of vibration caused by sound wave. In embodiments, the movable membrane 202 may have a shape of square.

Comb fingers 201*f* are fixed on anchor, and comb fingers 202*f* are integrated with membrane-shaped second electrical conductor 202 (hereinafter membrane 202 for simplicity). When membrane 202 vibrates due to sound wave, fingers 202*f* move together with membrane 202. The overlap area between two neighboring fingers 201*f* and 202*f* changes along with this movement, so does the capacitance. Eventually a capacitance change signal is (e.g. S1 or S2) detected that is the same as conventional capacitive microphone.

Figure 8:
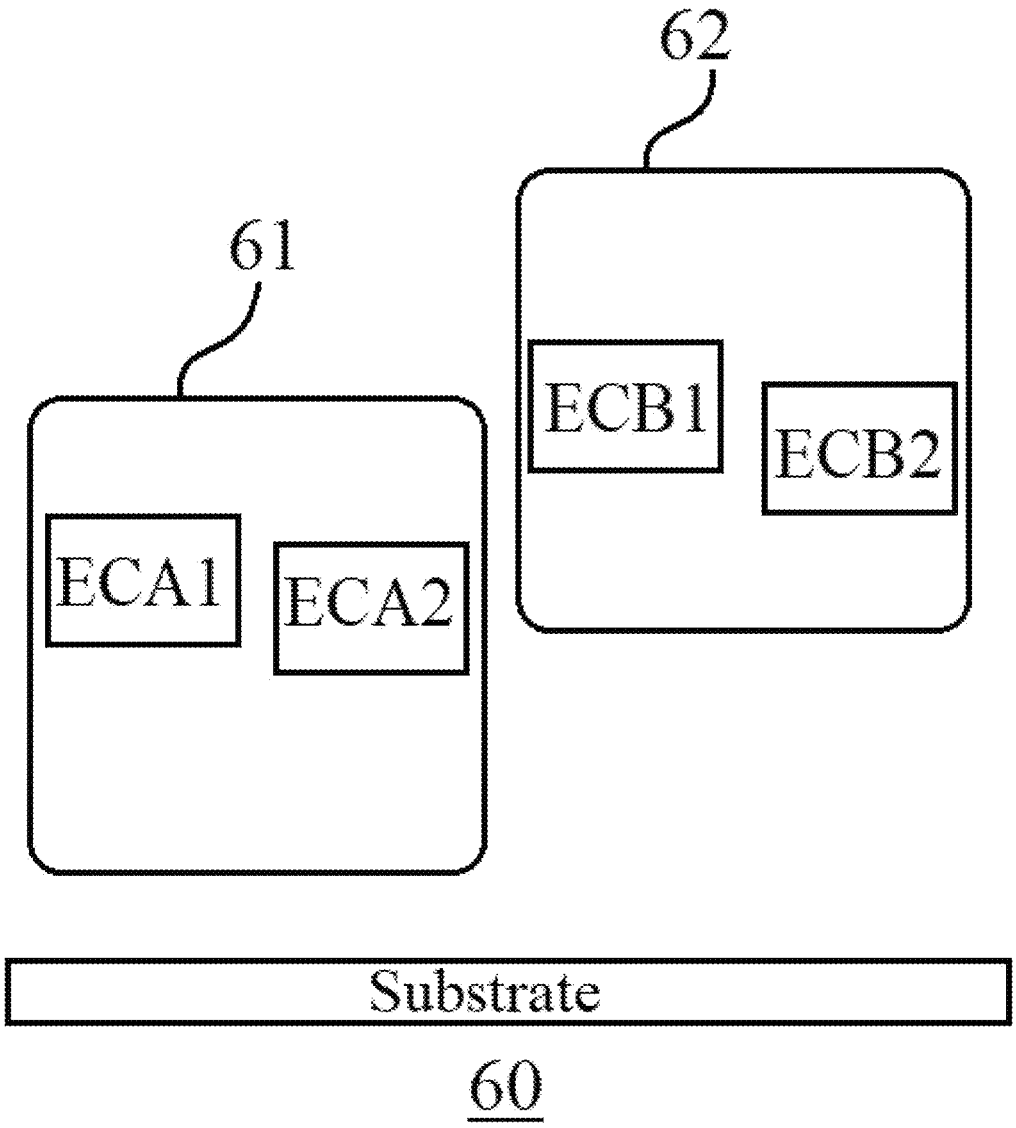
FIG. 8 schematically shows a capacitive microphone in accordance with an exemplary embodiment of the present invention that includes one or two pairs of capacitor plates arranged in lateral mode configuration.

Referring back to FIG. 2B, the second capacitor 62 may be a capacitor of any design, including a parallel-plate design as shown in FIG. 1A, as long as signal output S1 is substantially the additive inverse of signal output S2 As shown in FIG. 8, the second capacitor 62 may include a third electrical conductor ECB1 and a fourth electrical conductor ECB2. Conductors ECB1 and ECB2 may be built like thin layers 101 and 102 that are placed closely in almost parallel as shown in FIG. 1A One of conductors ECB1 and ECB2 is fixed backplate 101, and the other one is movable/deflectable membrane/diaphragm 102, which can be moved or driven by sound pressure. Diaphragm 102 acts as one plate of a capacitor, and the vibrations thereof produce changes in the distance between two layers 101 and 102, and changes in the mutual capacitance therebetween.

In preferred embodiments, conductors ECB1 and ECB2 are also configured in a lateral mode, like conductors ECA1 and ECA2 (or conductors 210 and 202) as described above and illustrated in FIGS. 2A-7. For conciseness, the description and illustration of ECB1 and ECB2 configured in a lateral mode will be omitted.

The first capacitor 61 and the second capacitor 62 as shown in FIG. 8 may be structurally and functionally independent of each other, as long as signal output S1 is substantially the additive inverse of signal output S2. However, in preferred embodiments, capacitors 61 and 62 are structurally and functionally related to each other. For example, they can share the same primary direction the same substrate 230. The common substrate 230 can be viewed as the conceptual plane Like conductors ECA1 and ECA2 that are constructed above the substrate 230 side-by-side, conductors ECB1 and ECB2 are also constructed above the substrate 230 side-by-side.

In more preferred embodiments, one of conductors ECA1 and ECA2 is electrically connected to one of conductors ECB1 and ECB2 to form a single shared conductor. The electrical connection can be accomplished by physical integration and/or merge of two conductors, or by electrical wire connection of two separate conductors. In the following examples, two conductors ECA2 and ECB1 form one single conductor (designated as "ECA2B1") by physical integration and/or merge of the two conductors, or by electrical wire connection of the two separate conductors. It should be appreciated that the single conductor ECA2B1 may be moveable or stationary/fixed relative to the common substrate 230, as will be described in more details.

Moveable Single Conductor with Stationary Composite Conductor

Figure 9:
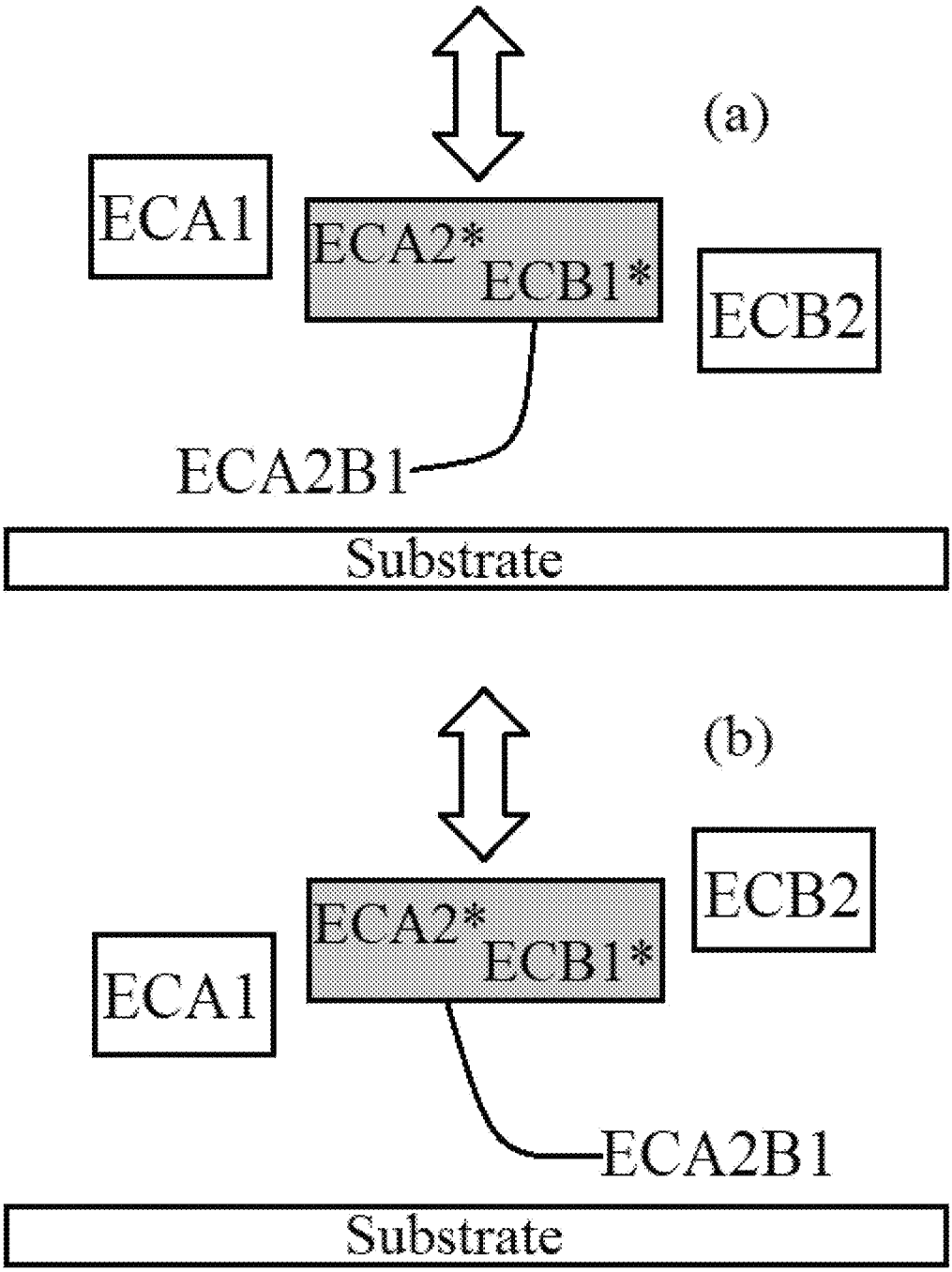
FIG. 9 schematically shows a moveable single conductor with "Even Height" electrically shared by the first lateral mode capacitor and the second lateral mode capacitor in accordance with an exemplary embodiment of the present invention.
Figure 10:
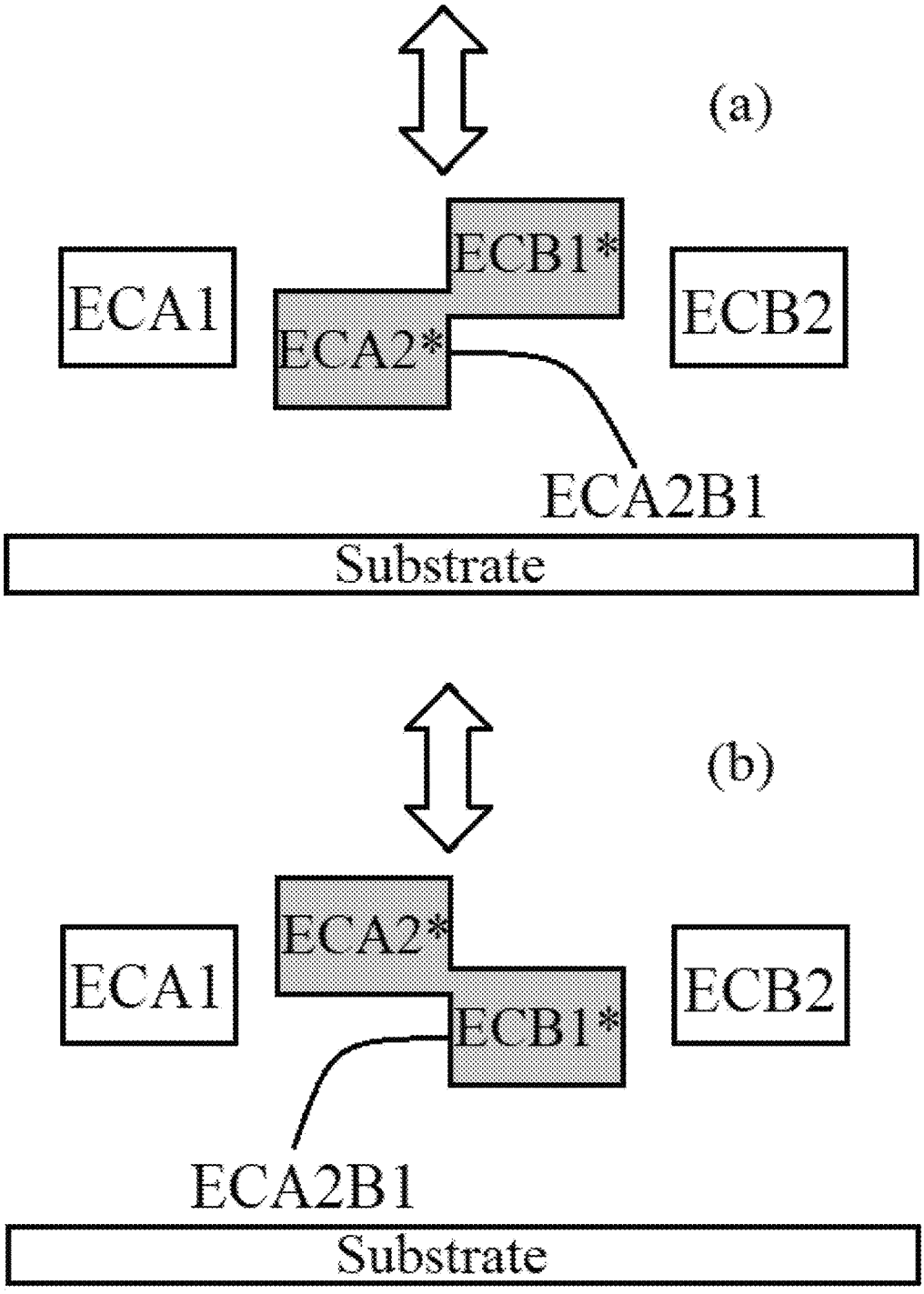
FIG. 10 schematically shows a moveable single conductor with "Uneven Height" electrically shared by the first lateral mode capacitor and the second lateral mode capacitor in accordance with an exemplary embodiment of the present invention.

FIG. 9 schematically shows a capacitive microphone 60 in accordance with an exemplary embodiment of the present invention that includes a moveable single conductor with "Even Height" shared by the first lateral mode capacitor 61 and the second lateral mode capacitor 62. FIG. 10 schematically shows a capacitive microphone 60 in accordance with an exemplary embodiment of the present invention that includes a moveable single conductor with "Uneven Height" shared by the first lateral mode capacitor 61 and the second lateral mode capacitor 62. Referring to FIGS. 9-10, electrically separated conductors ECA1 and ECB2 are fixed relative to the substrate 230; single conductor ECA2B1 comprises a membrane that is movable relative to the common substrate 230; and the common primary direction is perpendicular to the membrane plane. Conductor ECA1 may include a flat layer in parallel to the substrate 230 and having a thickness ECA1t and a height ECA1h along the primary direction as measured from the substrate 230. Similarly, conductor ECB2 may include a flat layer in parallel to the substrate 230 and having a thickness ECB2t and a height ECB2h along the primary direction as measured from the same substrate 230. Single conductor ECA2B1 comprises a portion ECA2* facing conductor ECA1. Portion ECA2* may include a flat layer in parallel to the substrate and having a thickness ECA2*t and a height ECA2*h along the primary direction as measured from the same substrate. Likewise, single conductor ECA2B1 comprises another portion ECB1* facing conductor ECB2. and portion ECB1* comprises a flat layer in parallel to the substrate and having a thickness ECB1*t and a height ECB1*h along the primary direction as measured from the same substrate.

In preferred but still exemplary embodiments, thickness ECA1t and thickness ECA2*t are substantially equal (within ±10% deviation) or exactly equal. Likewise, thickness ECB2t and thickness ECB1*t are substantially equal (within ±10% deviation) or exactly equal. Preferably, thickness ECA1t, thickness ECA2*t, thickness ECB2t, and thickness ECB1*t are substantially the same or exactly same, and are equal to ABt. Height difference ΔAh is herein defined as height ECA1h minus (subtract) height ECA2*h (ECA1h–ECA2*h); and height difference ΔBh is herein defined as height ECB1*h minus (subtract) height ECB2h (ECB1*h–ECB2h). $\Delta Ah \neq 0$ such as $\Delta Ah > 0$ or $\Delta Ah < 0$, $\Delta B \neq 0$ such as $\Delta Bh > 0$ or $\Delta Bh < 0$, but ΔAh=413h. In more preferred embodiments, the absolute values of ΔAh and ΔBh are about one third of ABt, $|\Delta Ah| \approx |\Delta Bh| \approx 1/3ABt$ or $|\Delta Ah| = |\Delta Bh| = 1/3ABt$.

In specific embodiments as shown in FIG. 9, height ECA2*h=height ECB1*h. In the upper panel (a) of FIG. 9, $\Delta Ah > 0$, $\Delta Bh > 0$, and $\Delta Ah = \Delta Bh$. In the lower panel (b) of FIG. 9, $\Delta Ah < 0$, $\Delta Bh < 0$, and $\Delta Ah = \Delta Bh$. In other specific embodiments as shown in FIG. 10, height ECA1h=height ECB2h. In the upper panel (a) of FIG. 10, $\Delta Ah > 0$, $\Delta Bh > 0$, and $\Delta Ah = \Delta Bh$. In the lower panel (b) of FIG. 10, $\Delta Ah < 0$, $\Delta Bh < 0$, and $\Delta Ah = \Delta Bh$.

Figure 11:
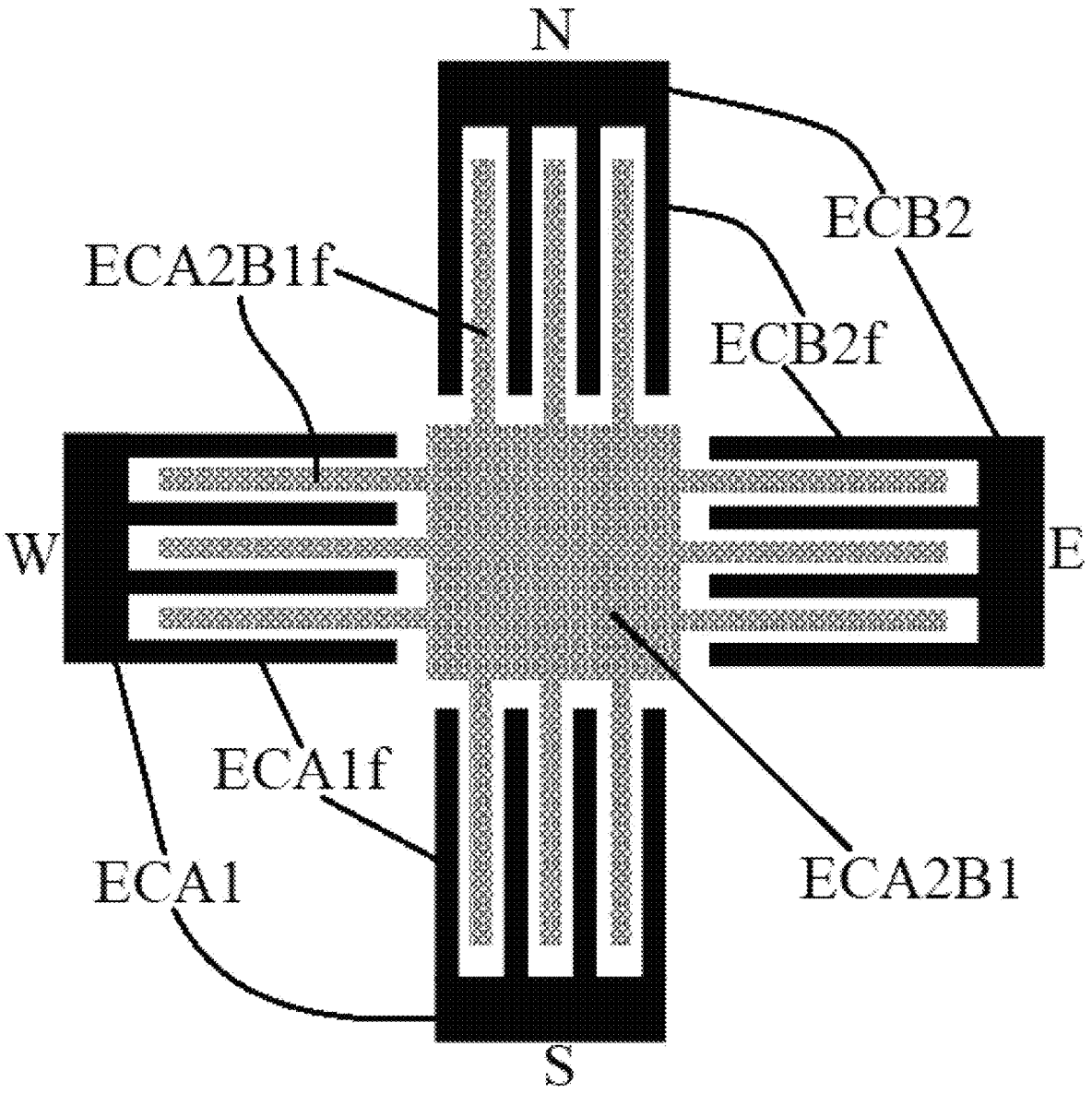
FIG. 11 is the top view of one configuration as shown in FIGS. 9 and 10 combined with comb fingers as shown in FIG. 6 in accordance with an exemplary embodiment of the present invention.

FIG. 11 is a top view of the configurations as shown in FIGS. 9 and 10 combined with comb fingers as shown in FIG. 6. Conductor ECA1 comprises a set of comb fingers ECA1f, and conductor ECB2 comprises a set of comb fingers ECB2f. The movable membrane of single conductor ECA2B1 comprises a set of comb fingers ECA2B1f around the peripheral region of the membrane. Comb fingers ECA1f and comb fingers ECB2f are interleaved into comb fingers ECA2B1f. As described above, single conductor ECA2B1 comprises a portion ECA2* (not shown) facing conductor ECA1 and another portion ECB1* (not shown) facing conductor ECB2. Comb fingers ECA2B1f are laterally movable relative to both comb fingers ECA1f and comb fingers ECB2f, and the resistance from air located within a gap between the membrane and the substrate is lowered. The movable membrane of single conductor ECA2B1 may be square shaped as shown in FIG. 11. However, it is contemplated that the movable membrane of single conductor ECA2B1 may have a shape of circle, triangle, hexagon, and octagon etc. In preferred embodiments, comb fingers ECA2B1f, comb fingers ECA1f, and comb fingers ECB2f have identical shape, dimension, and spatial arrangement. The movable membrane of single conductor ECA2B1 is attached to the substrate via three or more suspensions such as four suspensions (like suspensions 202S as shown in FIG. 5); and each suspension may include folded and symmetrical cantilevers.

Figure 12:
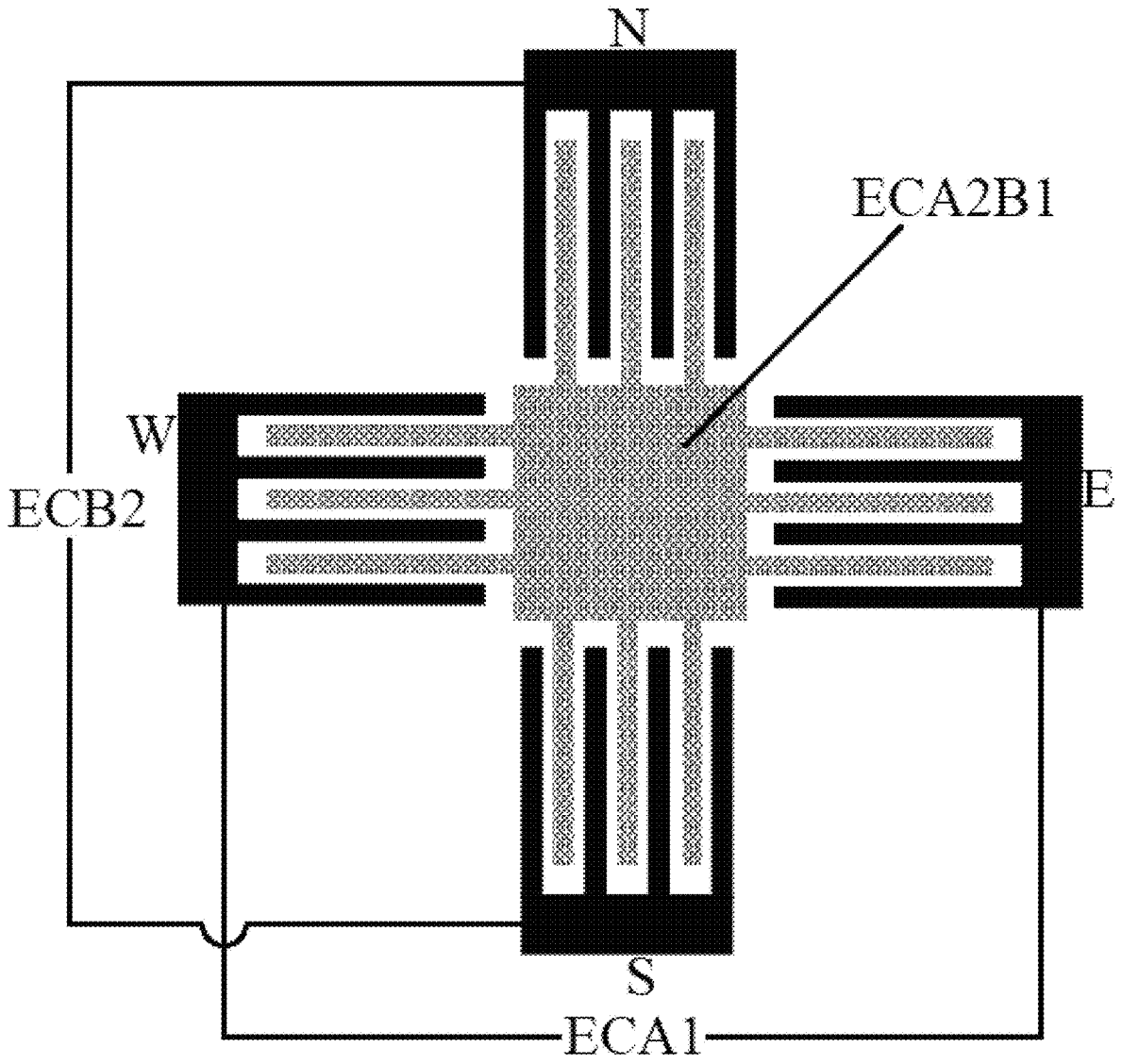
FIG. 12 is the top view of another configuration as shown in FIGS. 9 and 10 combined with comb fingers as shown in FIG. 6 in accordance with an exemplary embodiment of the present invention.
Figure 13:
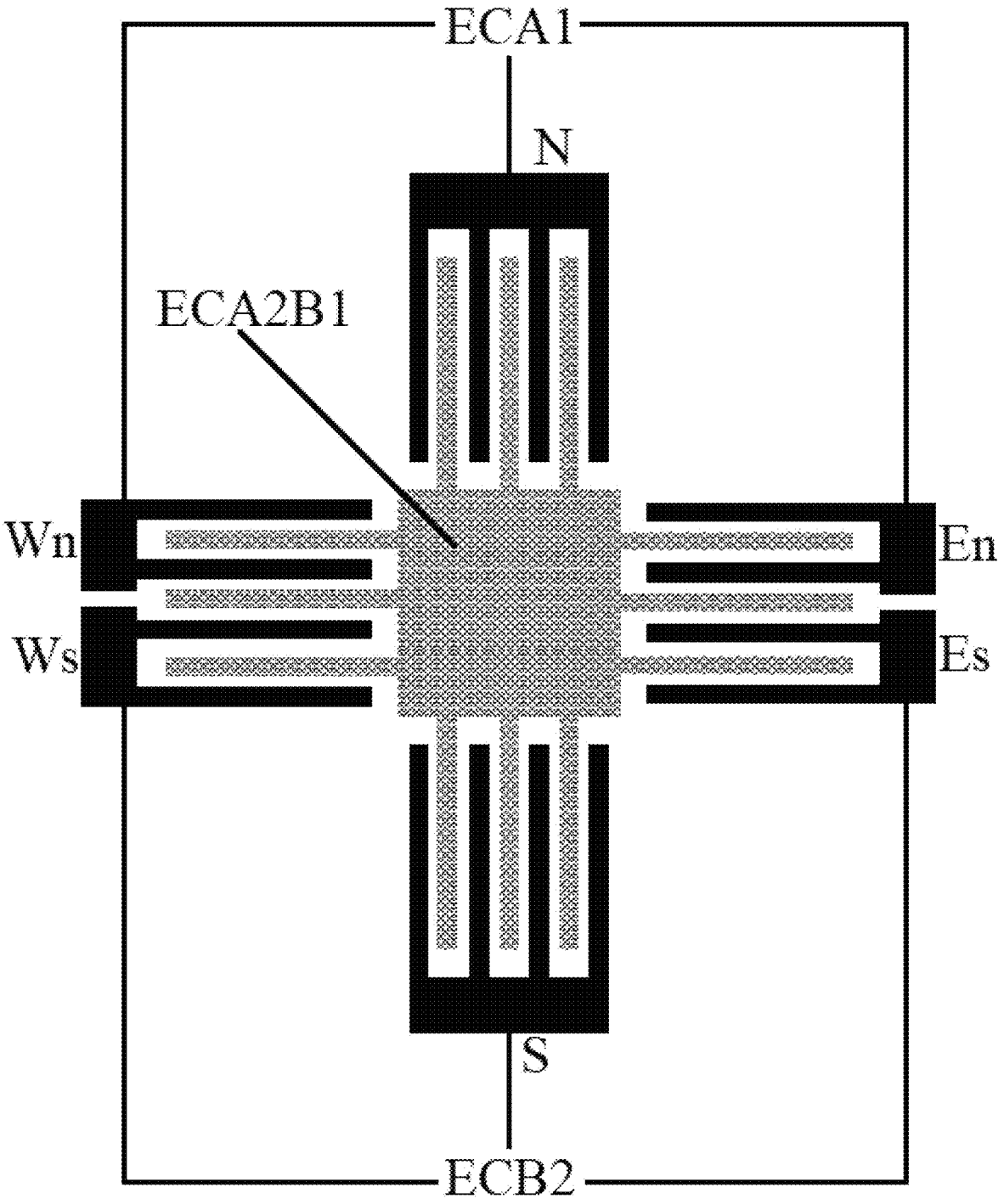
FIG. 13 is the top view of still another configuration as shown in FIGS. 9 and 10 combined with comb fingers as shown in FIG. 6 in accordance with an exemplary embodiment of the present invention.
Figure 14:
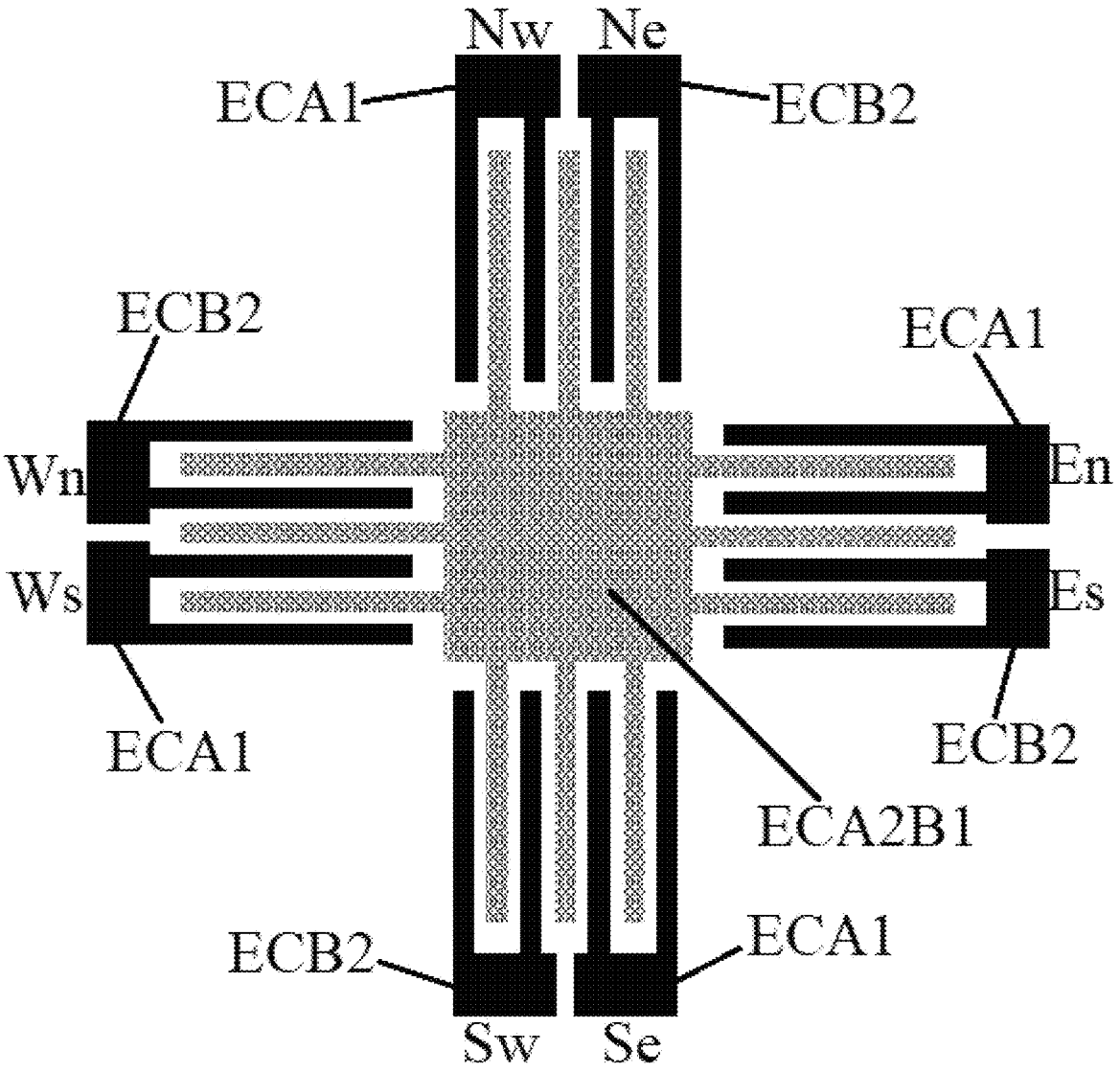
FIG. 14 is the top view of a further configuration as shown in FIGS. 9 and 10 combined, with comb fingers as shown in FIG. 6 in accordance with an exemplary embodiment of the present invention.

As shown in FIG. 11, the square-shaped movable membrane of single conductor ECA2B1 may face or overlap four electrode banks N, S, E and W. Comb fingers extended from conductor ECA2B1 are interleaved into comb fingers extended from banks N, S, E and W. Any two neighboring banks with their respective comb fingers may be electrically connected, and constitute conductor ECA1 (e.g. N+E, E+S, S+W and W+N), while the other two neighboring banks with their respective comb fingers may be electrically connected and constitute conductor ECB2 (e.g. S+W, W+N, N+E and E+S respectively). As shown in FIG. 12, any two opposite banks with their respective comb fingers may be electrically connected, and constitute conductor ECA1 (e.g. N+S and E+W), while the other two opposite banks with their respective comb fingers may be electrically connected, and constitute conductor ECB2 (e.g. E+W and N+S respectively). As shown in FIG. 13, only two opposite banks with their respective comb fingers may be split into two sub-banks. For example, bank E is split half into sub-bank Es and sub-bank Es; and bank W is split half into sub-bank Ws and sub-bank Ws. Bank N, sub-bank En and sub-bank Wn may be electrically connected, and constitute conductor ECA1, while bank S, sub-bank Es and sub-bank Ws may be electrically connected and constitute conductor ECB2. As shown in FIG. 14, all the four banks N, S, E and W with their respective comb fingers may be split into 4 pairs of sub-banks, Ne and Nw, Se and Sw, En and Es, and Wn and Ws. Four sub-banks from the 4 pairs may be electrically connected and constitute conductor ECA1, while other four sub-banks from the 4 pairs may be electrically connected and constitute conductor ECB2. For example, sub-banks Nw, En, Se and Ws may be electrically connected and they constitute conductor ECA1, while sub-banks Ne, Es, Sw and Wn may be electrically connected and they constitute conductor ECB2.

Figure 15:
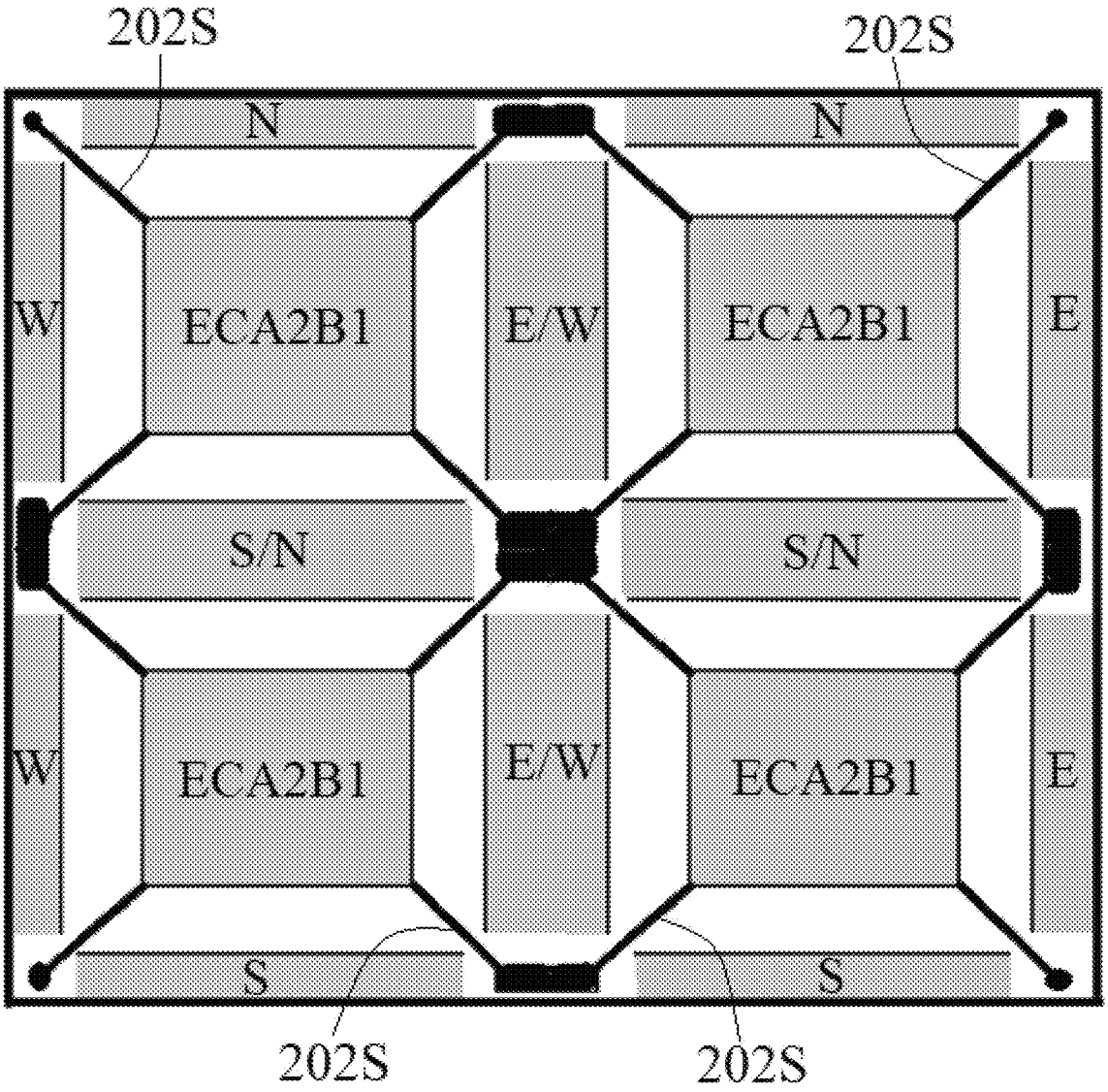
FIG. 15 shows that four movable single conductors as shown in FIGS. 11-14 are arranged in a 2×2 array configuration in accordance with an exemplary embodiment of the present invention.

The capacitive microphone of the invention may include one or more movable membranes of single conductor ECA2B1 For example, four movable membranes of single conductor ECA2B1 can be arranged in a 2×2 array configuration. As shown in FIG. 15, four movable single conductors as shown in FIGS. 11-14 may be arranged in a 2×2 array configuration.

Figure 16:
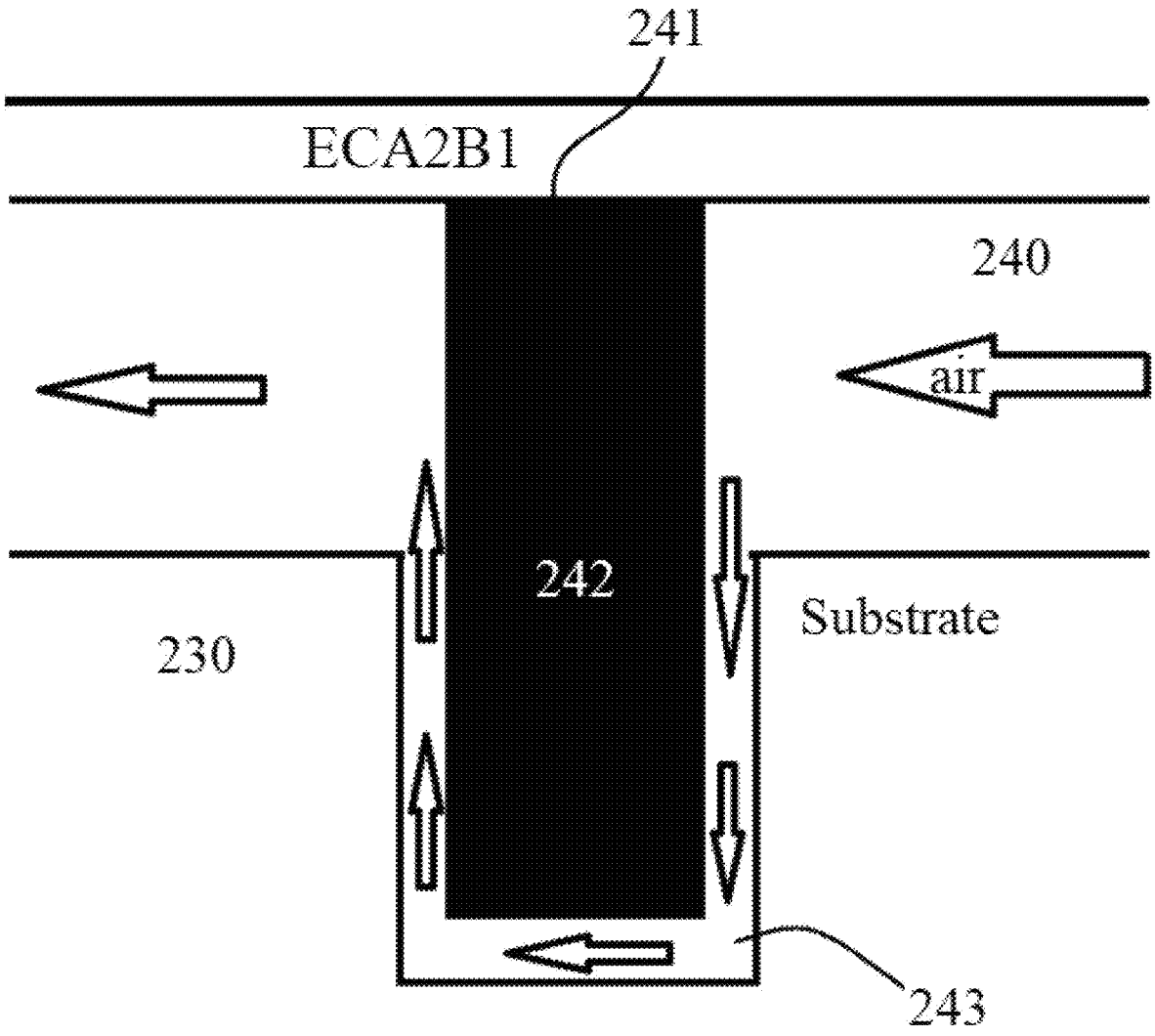
FIG. 16 demonstrates the design of one air flow restrictor between the substrate and the movable single conductors as shown in FIGS. 11-14 in accordance with an exemplary embodiment of the present invention.
Figure 17:
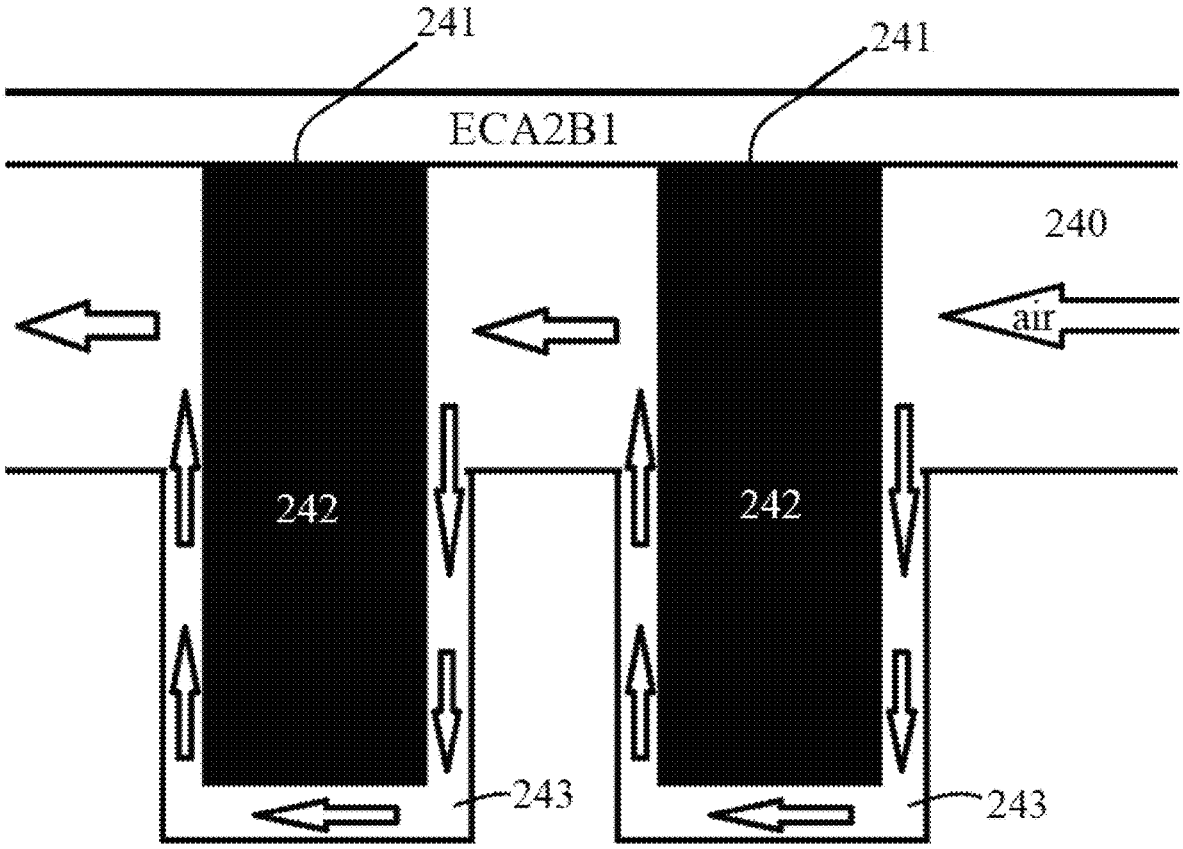
FIG. 17 demonstrates the design of two serial and co-centered flow restrictors between the substrate and the movable single conductors as shown in FIGS. 11-14 in accordance with an exemplary embodiment of the present invention.

Leakage is often an issue in microphone design. In conventional parallel plate design as shown in FIG. 1A, it typically has a couple of tiny holes around the edge in order to let air go through slowly, to keep air pressure balance on both sides of membrane 101 in low frequency. That is a desired leakage. However, a large leakage is undesired, because it will let some low frequency sound wave escape away from membrane vibration easily via the holes; and will result in a sensitivity drop in low frequency. In some embodiments as shown in FIGS. 16 and 17, the capacitive microphone of the invention comprises one, two or more air flow restrictors 241 that restrict the flow rate of air that flows in/out of the gap between the membrane 202 of single conductor ECA2B1 and the substrate 230. Air flow restrictors 241 may be designed to decrease the size of an air channel 240 for the air to flow in/out of the gap. Alternatively or additionally, air flow restrictors 241 may increase the length of the air channel 240 for the air to flow in/out of the gap. For example, air flow restrictors 241 may comprise an insert 242 into a groove 243, which not only decreases the size of an air channel 240, but also increases the length of the air channel 240. Air flow restrictors 241 may function as a structure for preventing air leakage in the microphone of the invention. In MEMS microphones, a deep slot may be etched on substrate around the edge of square membrane of conductor ECA2B1 Then, an insert/wall 242 connected to (or extended from) the square membrane is deposited to form a long and narrow air tube 240, which gives a large acoustic resistance.

Movable Composite Conductor with Stationary Single Conductor

Figure 18:
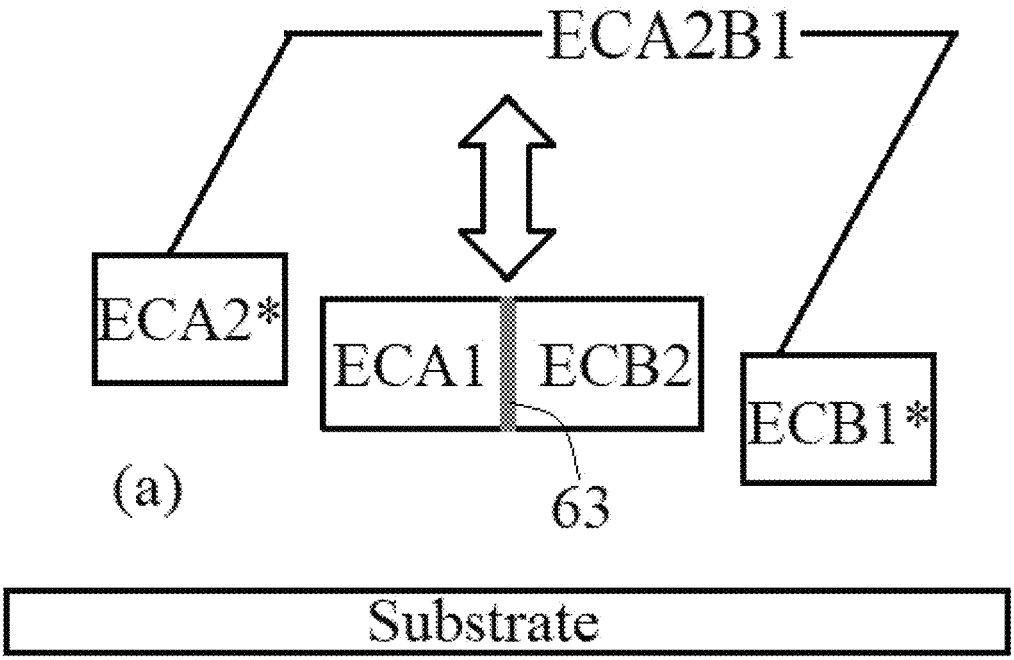
FIG. 18 schematically shows a moveable composite conductor with "Even Height" formed from the first lateral mode capacitor and the second lateral mode capacitor (which remain electrically separated) in accordance with an exemplary embodiment of the present invention.
Figure 18:
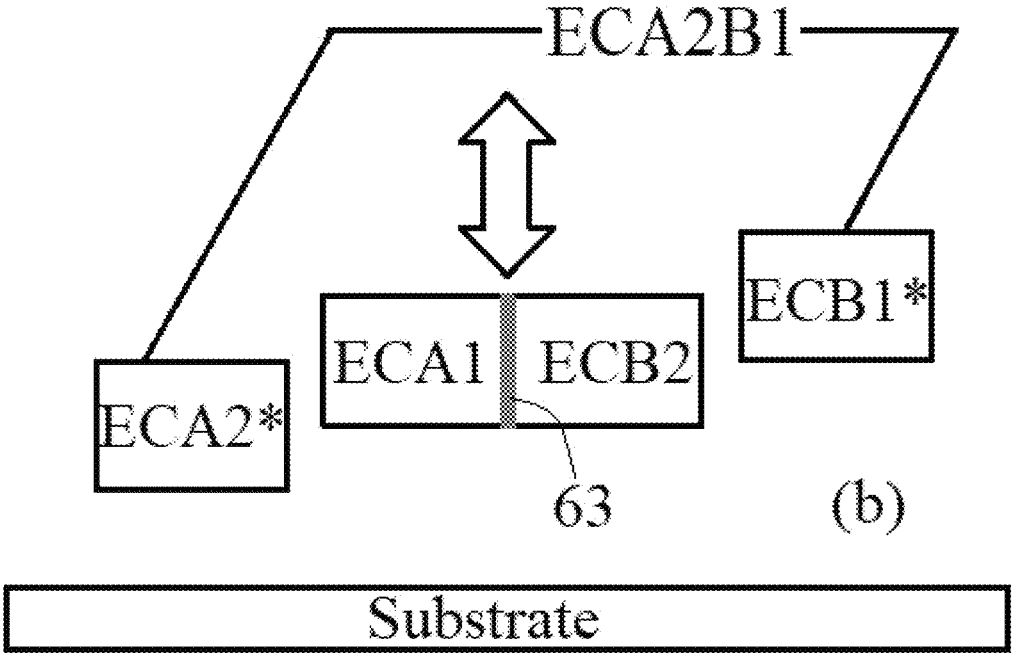
Figure 19:
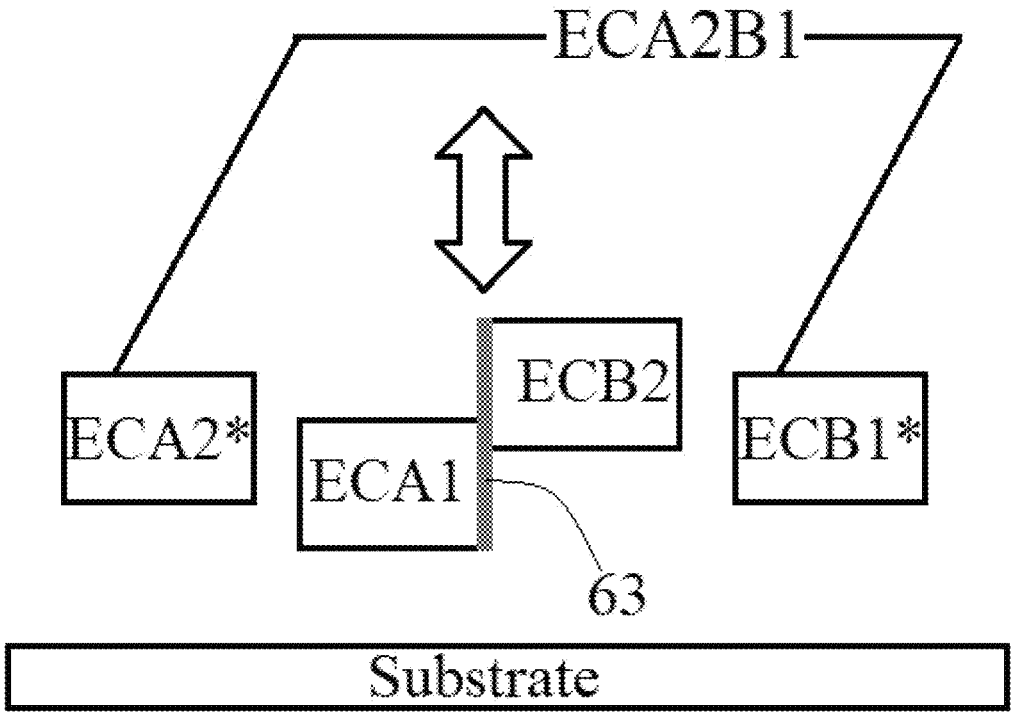
FIG. 19 schematically shows a moveable composite conductor with "Uneven Height" formed from the first lateral mode capacitor and the second lateral mode capacitor (which remain electrically separated) in accordance with an exemplary embodiment of the present invention.
Figure 19:
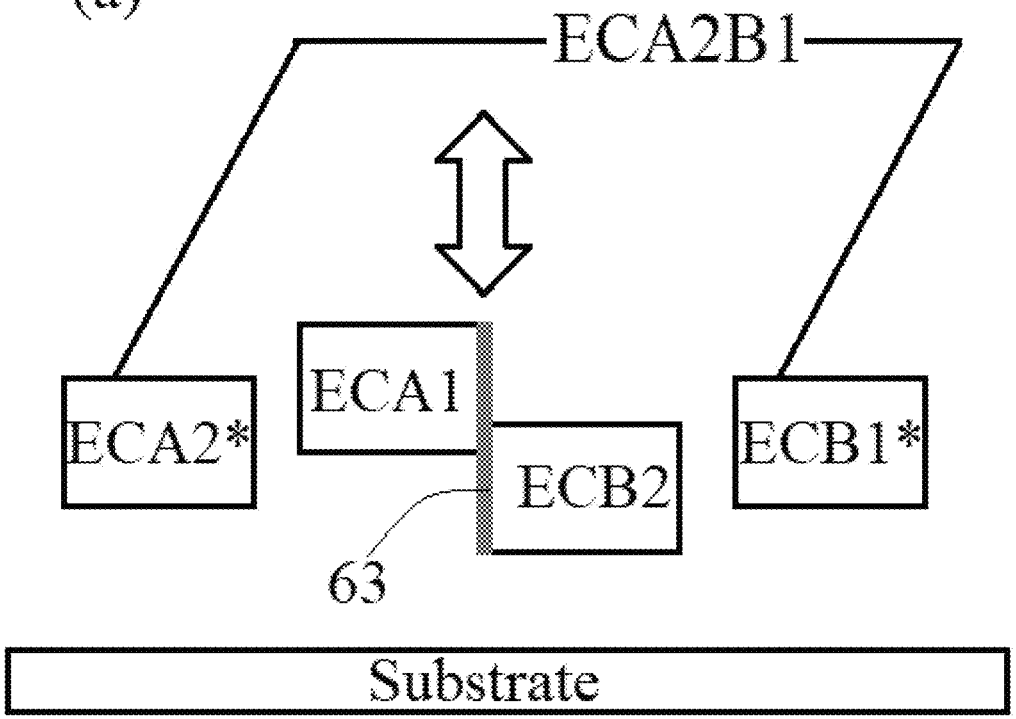

In some other embodiments, a moveable composite conductor with "Even Height" or "Uneven Height" may be formed from the first lateral mode capacitor and the second lateral mode capacitor (which remain electrically separated) As shown in FIGS. 18-19, single conductor ECA2B1 is fixed relative to the substrate 230. Conductors ECA1 and ECB2 are electrically separated but physically combined (e.g. using an electrical insulator 63 between ECA1 and ECB2) into a composite conductor ECA1B2 that includes a membrane movable relative to the substrate, and the common primary direction is perpendicular to the membrane plane. Conductor ECA1 in the composite conductor ECA1B2 may include a flat layer in parallel to the substrate 230 and having a thickness ECA1t and a height ECA1h along the primary direction as measured from the substrate 230. Similarly, conductor ECB2 in the composite conductor ECA1B2 may include a flat layer in parallel to the substrate 230 and having a thickness ECB2t and a height ECB2h along the primary direction as measured from the same substrate Single conductor (electrically speaking) ECA2B1 comprises a portion ECA2* facing conductor ECA1, and portion ECA2* comprises a flat layer in parallel to the substrate and having a thickness ECA2*t and a height ECA2*h along the primary direction as measured from the same substrate. Likewise, single conductor ECA2B1 comprises a portion ECB1* facing conductor ECB2, and portion ECB1* also comprises a flat layer in parallel to the substrate 230 and having a thickness ECB1*t and a height ECB1*h along the primary direction as measured from the same substrate.

In preferred but still exemplary embodiments, thickness ECA1t and thickness ECA2*t are substantially equal (within ±10% deviation). Likewise, thickness ECB2t and thickness ECB1*t are substantially equal (within ±10% deviation). Preferably, thickness ECA1t, thickness ECA2*t, thickness ECB2t, and thickness ECB1*t are substantially the same, and are equal to ABt. Height difference ΔAh is defined as height ECA2*h minus (subtract) height ECA1h, ΔAh=ECA2*h−ECA1h Height difference ΔBh is defined as height ECB2h minus (subtract) height ECB1*h, ΔBh=ECB2h−ECB1*h $\Delta Ah \neq 0$ such as $\Delta Ah>0$ or $\Delta Ah<0$, $\Delta Bh \neq 0$ such as $\Delta Bh>0$ or $\Delta Bh<0$, but ΔAh=ΔBh. In more preferred embodiments, the absolute values of ΔAh and ΔBh are about one third of ABt, $|\Delta Ah| \approx |\Delta Bt|$ or $|\Delta Ah|=|\Delta Bh|=1/3ABt$.

In specific embodiments as shown in FIG. 18, height ECA1h=height ECB2h. In the upper panel (a) of FIG. 18, $\Delta Ah>0$, $\Delta Bh>0$, and ΔAh=ΔBh. In the lower panel (b) of FIG. 18, $\Delta Ah<0$, $\Delta Bh<0$, and ΔAh=ΔBh. In other specific embodiments as shown in FIG. 19, height ECA2*h=height ECB1*h. In the upper panel (a) of FIG. 19, $\Delta Ah>0$, $\Delta Bh>0$, and ΔAh=ΔBh. In the lower panel (b) of FIG. 19, $\Delta Ah<0$, $\Delta Bh<0$, and ΔAh=ΔBh.

Figure 20:
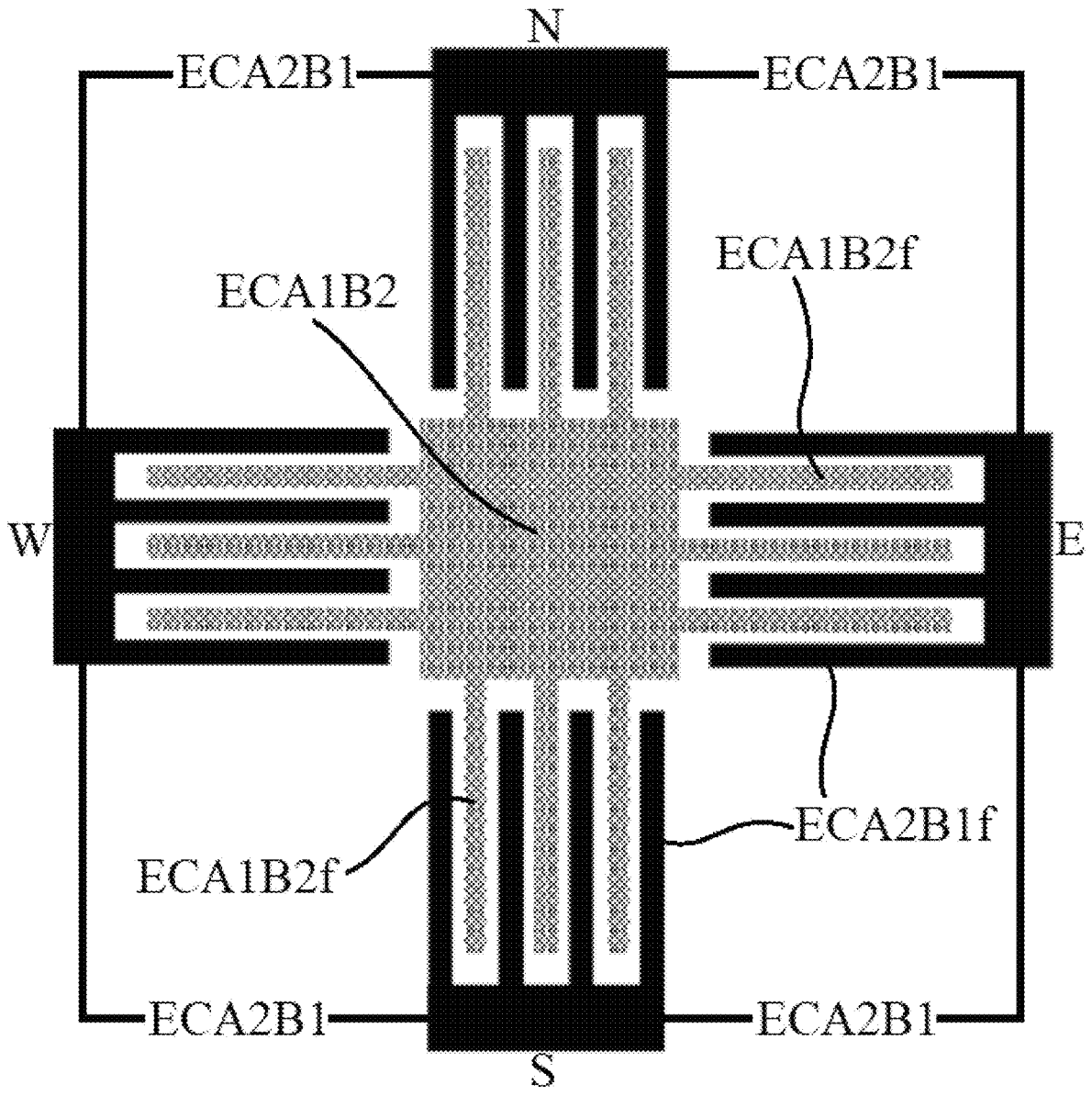
FIG. 20 is the top view of the general configuration as shown in FIGS. 18 and 19 combined with comb fingers as shown in FIG. 6 in accordance with an exemplary embodiment of the present invention.

While FIG. 20 is the top view of the general configuration as shown in FIGS. 18 and 19 combined with comb fingers as shown in FIG. 6, FIGS. 21-31 show some specific examples of such configuration. Referring to FIG. 20, single conductor ECA2B1 comprises a set of comb fingers ECA2B1f Portion ECA2* of single conductor ECA2B1 comprises a set of comb fingers ECA2*f. Portion ECB1* of single conductor ECA2B1 comprises a set of comb fingers ECB1*f. The movable membrane of composite conductor ECA1B2 comprises a set of comb fingers ECA1B2f around the peripheral region of the membrane. Comb fingers ECA2*f and comb fingers ECB1*f are interleaved into comb fingers ECA1B2f. As described above, single conductor ECA2B1 comprises a portion ECA2* (not shown) facing conductor ECA1 and another portion ECB1* (not shown) facing conductor ECB2. Comb fingers ECA1B2f are laterally movable relative to both comb fingers ECA2*f and comb fingers ECB1*f, and the resistance from air located within a gap between the membrane and the substrate is lowered.

The movable membrane of composite conductor ECA1B2 may be square shaped as shown in FIG. 20. However, it is contemplated that the movable membrane of composite conductor ECA1B2 may have a shape of circle, triangle, hexagon, and octagon etc. In preferred embodiments, comb fingers ECA1B2f, comb fingers ECA2*f, and comb fingers ECB1*f have identical shape, dimension, and spatial arrangement. The movable membrane of composite conductor ECA1B2 is attached to the substrate via three or more suspensions such as four suspensions (like suspensions 202S as shown in FIG. 5), and each suspension may include folded and symmetrical cantilevers.

As shown in FIG. 20, the square-shaped movable membrane of composite conductor ECA1B2 may face or overlap four electrically connected electrode banks N, S, E and W. Comb fingers extended from four sides of conductor ECA1B2 are interleaved into comb fingers extended from banks N, S, E and W.

Figure 21:
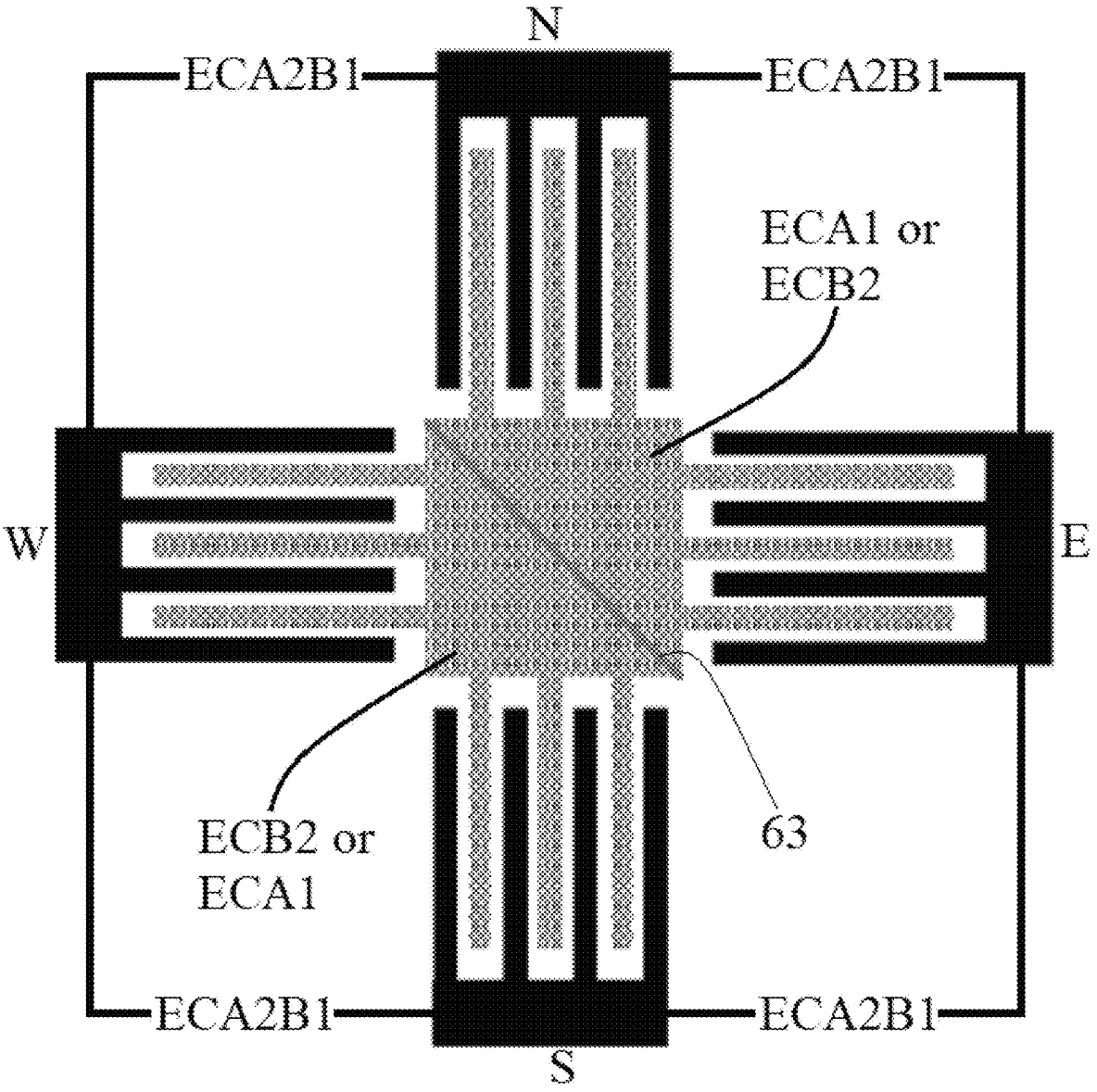
FIG. 21 is the top view of a first specific example of the general configuration as shown in FIG. 20 in accordance with an exemplary embodiment of the present invention.
Figure 22:
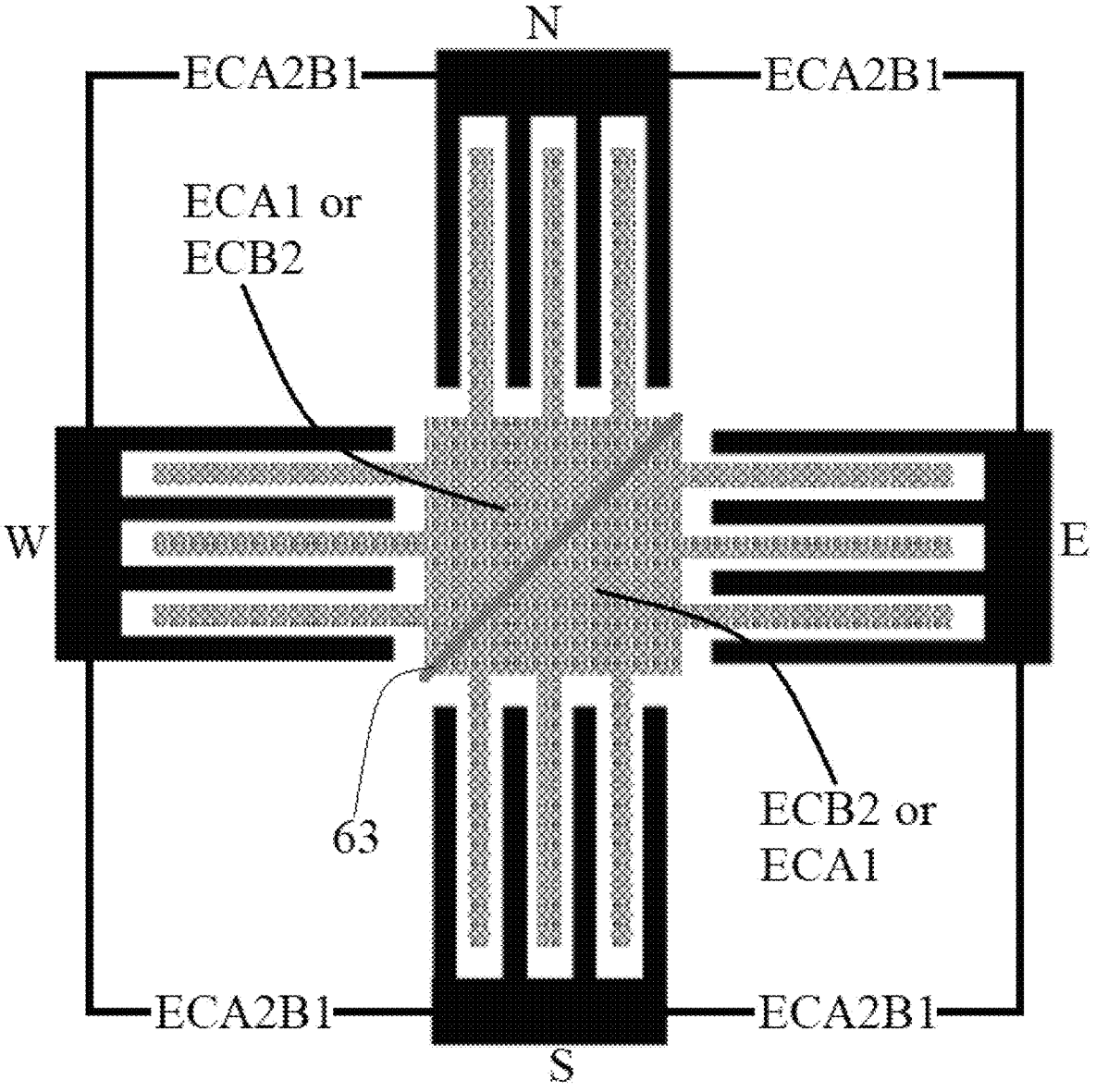
FIG. 22 is the top view of a second specific example of the general configuration as shown in FIG. 20 in accordance with an exemplary embodiment of the present invention
Figure 23:
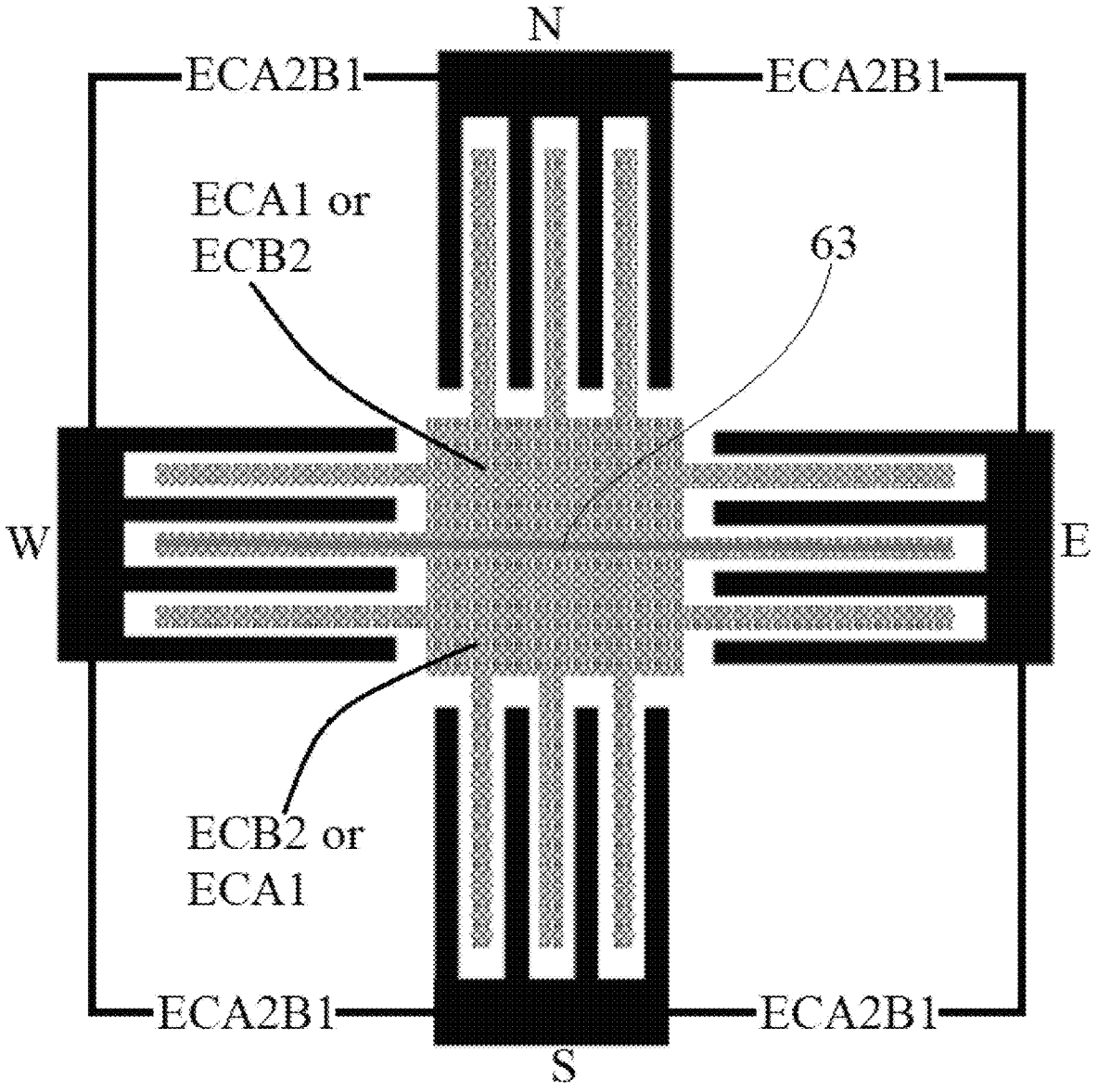
FIG. 23 is the top view of a third specific example of the general configuration as shown in FIG. 20 in accordance with an exemplary embodiment of the present invention.
Figure 24:
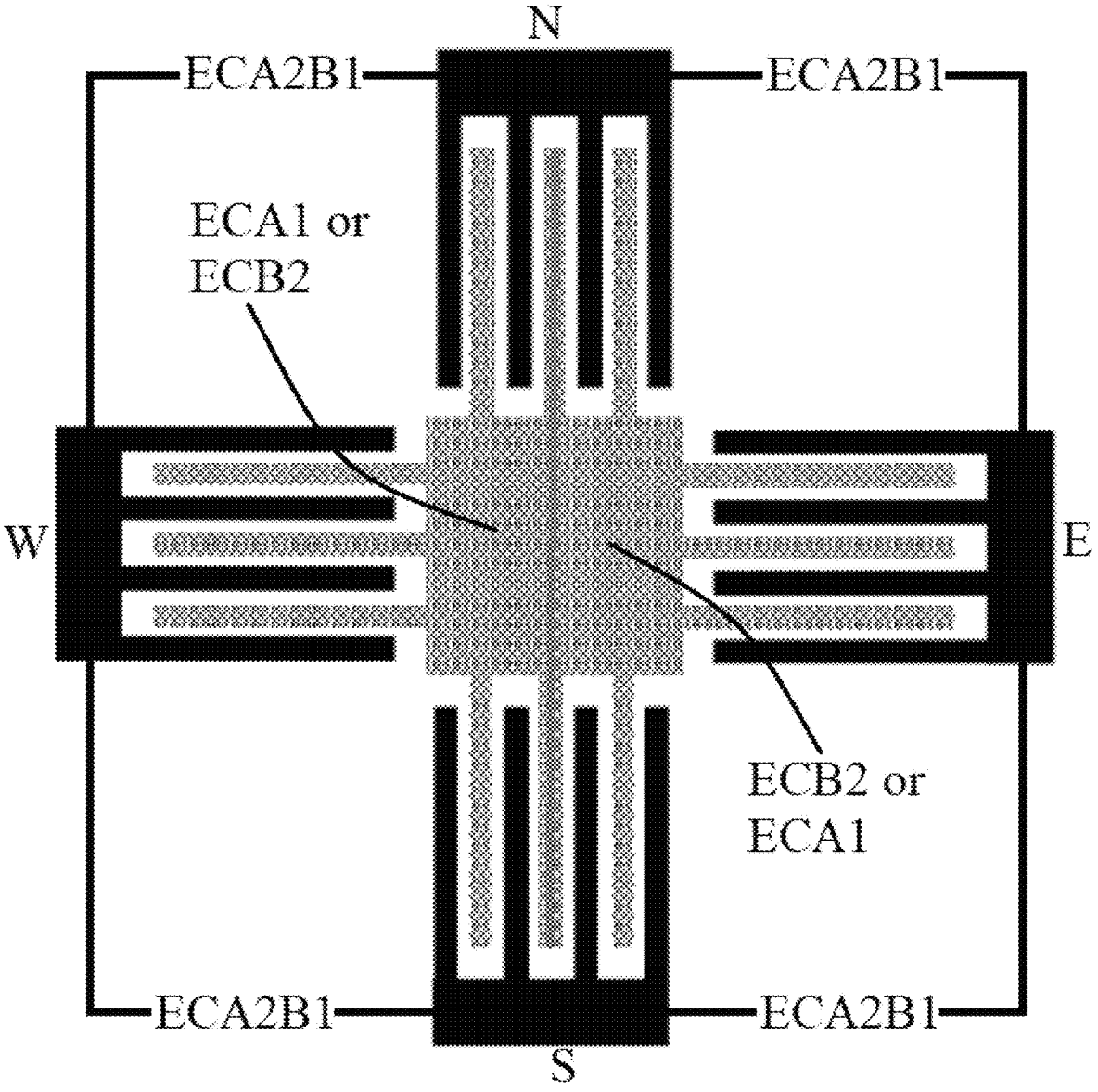
FIG. 24 is the top view of a fourth specific example of the general configuration as shown in FIG. 20 in accordance with an exemplary embodiment of the present invention.

Composite conductor ECA1B2 may be electrically divided into two electrodes ECA1 and ECB1 in any suitable way, for example, using an electrical insulator 63 between ECA1 and ECB2. As shown in FIGS. 21 and 22, an electrical insulator 63 along a diagonal line (either forward or backward) of the square-shaped membrane of composite conductor ECA1B2 can generate a pair of electrical conductors ECA1 and ECB2 located on two sides of the diagonal line, respectively. As shown in FIG. 23, an electrical insulator 63 along a horizontal middle line of the square-shaped membrane of composite conductor ECA1B2 can generate a pair of electrical conductors ECA1 and ECB2 located on two sides (above and below) of the horizontal middle line, respectively. As shown in FIG. 24, an electrical insulator 63 along a vertical middle line of the square-shaped membrane of composite conductor ECA1B2 can generate a pair of electrical conductors ECA1 and ECB2 located on two sides (right and left) of the vertical middle line, respectively.

Figure 25:
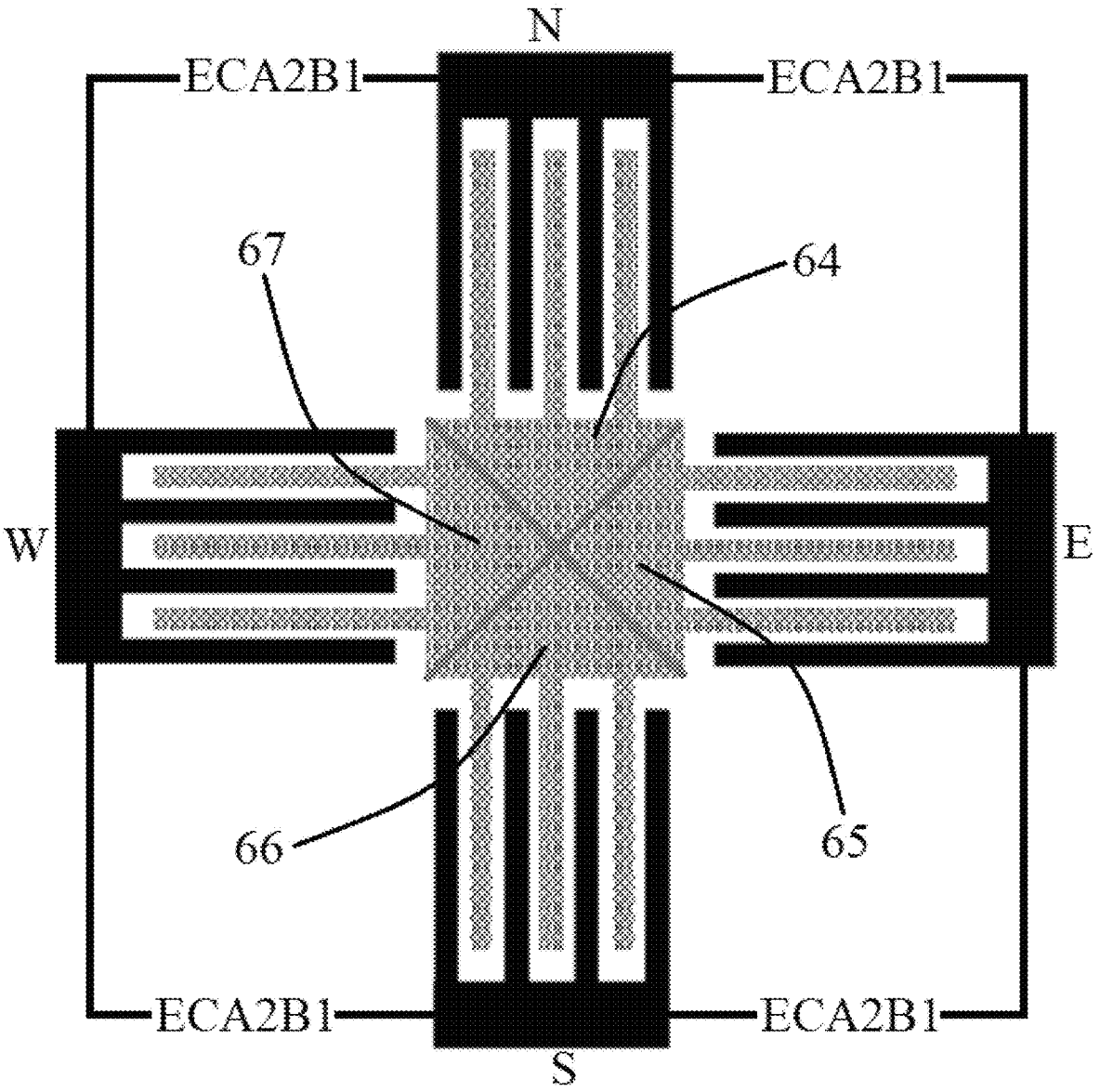
FIG. 25 is the top view of a fifth specific example of the general configuration as shown in FIG. 20 in accordance with an exemplary embodiment of the present invention.

As shown in FIG. 25, an electrical insulator 63 along both diagonal lines of the square-shaped membrane of composite conductor ECA can generate four sub-conductors 64, 65, 66 and 67. Sub-conductors 64 and 66 may be electrically connected and they together constitute one of electrical conductors ECA1 and ECB2. Sub-conductors 65 and 67 may be electrically connected and they together constitute another one of electrical conductors ECA1 and ECB2.

Figure 26:
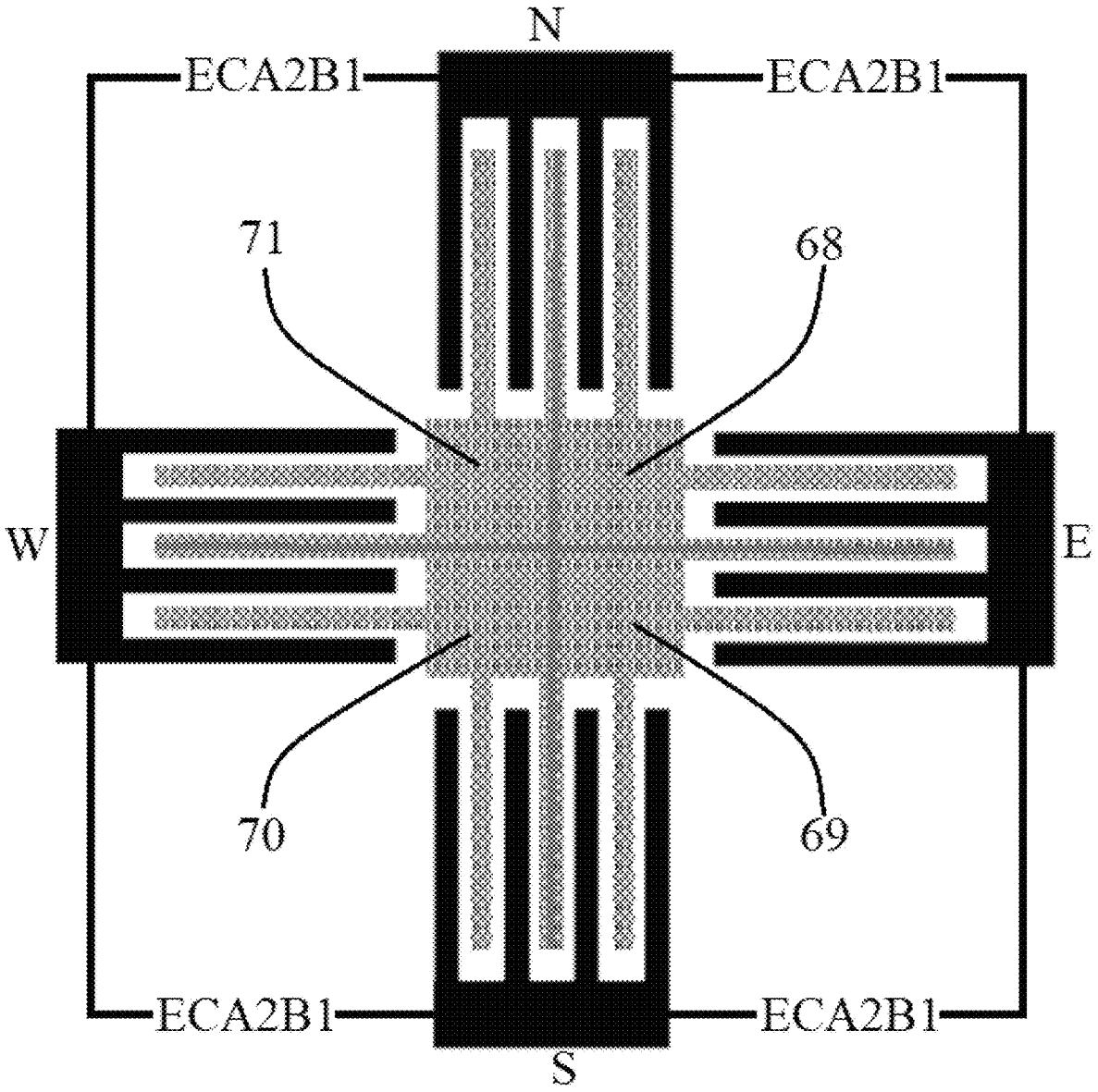
FIG. 26 is the top view of a sixth specific example of the general configuration as shown in FIG. 20 in accordance with an exemplary embodiment of the present invention.

As shown in FIG. 26, an electrical insulator 63 along both vertical middle line and horizontal middle line of the square-shaped membrane of composite conductor ECA1B2 can generate four sub-conductors 68, 69, 70 and 71. Sub-conductors 68 and 70 may be electrically connected and they together constitute one of electrical conductors ECA1 and ECB2. Sub-conductors 69 and 71 may be electrically connected and they together constitute another one of electrical conductors ECA1 and ECB2.

Figure 27:
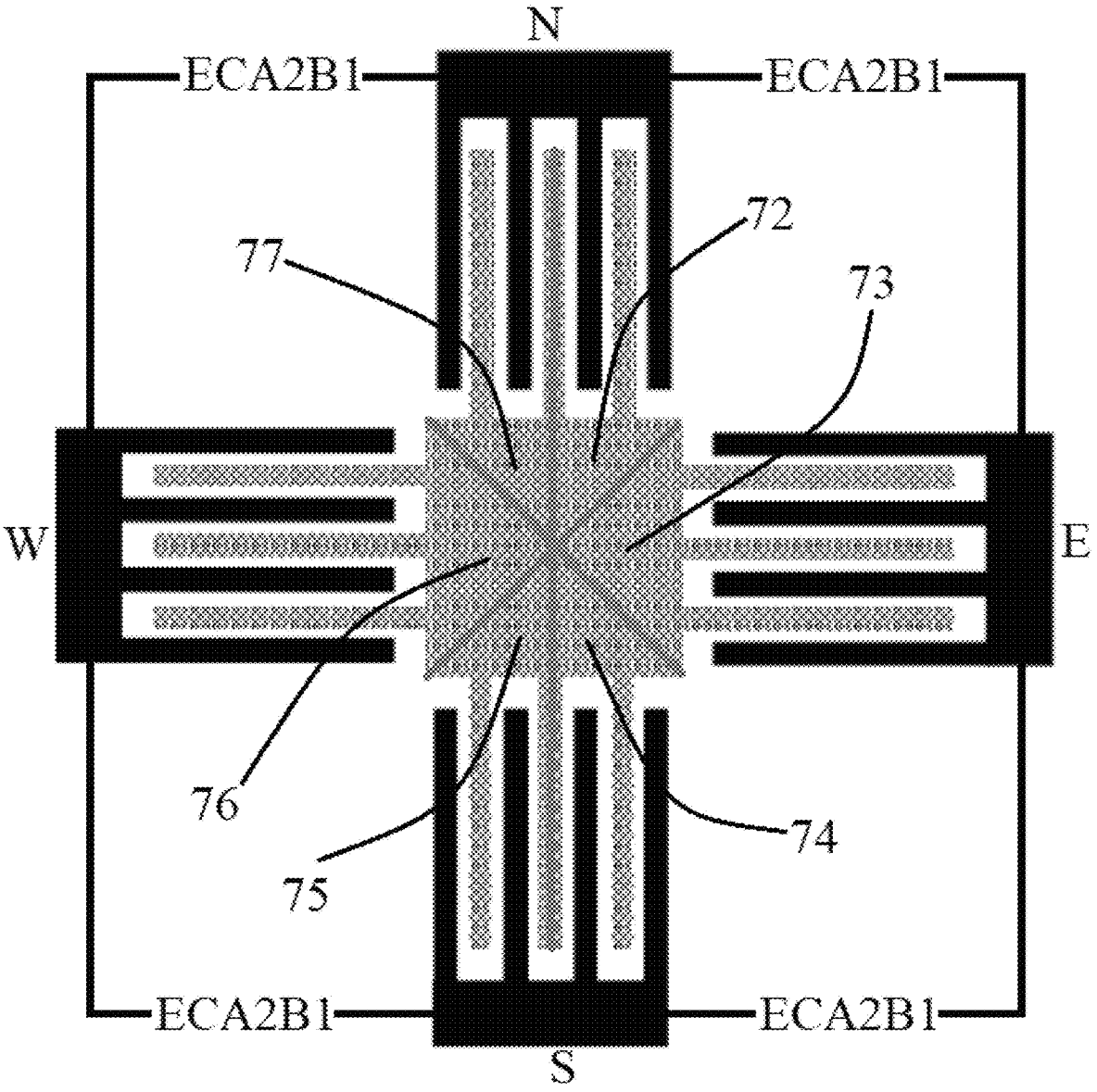
FIG. 27 is the top view of a seventh specific example of the general configuration as shown in FIG. 20 in accordance with an exemplary embodiment of the present invention.

As shown in FIG. 27, an electrical insulator 63 along both diagonal lines and the vertical middle line of the square-shaped membrane of composite conductor ECA1B2 can generate six sub-conductors 72, 73, 74, 75, 76 and 77. Sub-conductors 73, 72 and 75 may be electrically connected and they together constitute one of electrical conductors ECA1 and ECB2. Sub-conductors 76, 77 and 74 may be electrically connected and they together constitute another one of electrical conductors ECA1 and ECB2. An electrical insulator 63 along both diagonal lines and the horizontal middle line will generate similar sub-conductor combinations, which will be omitted here.

Figure 28:
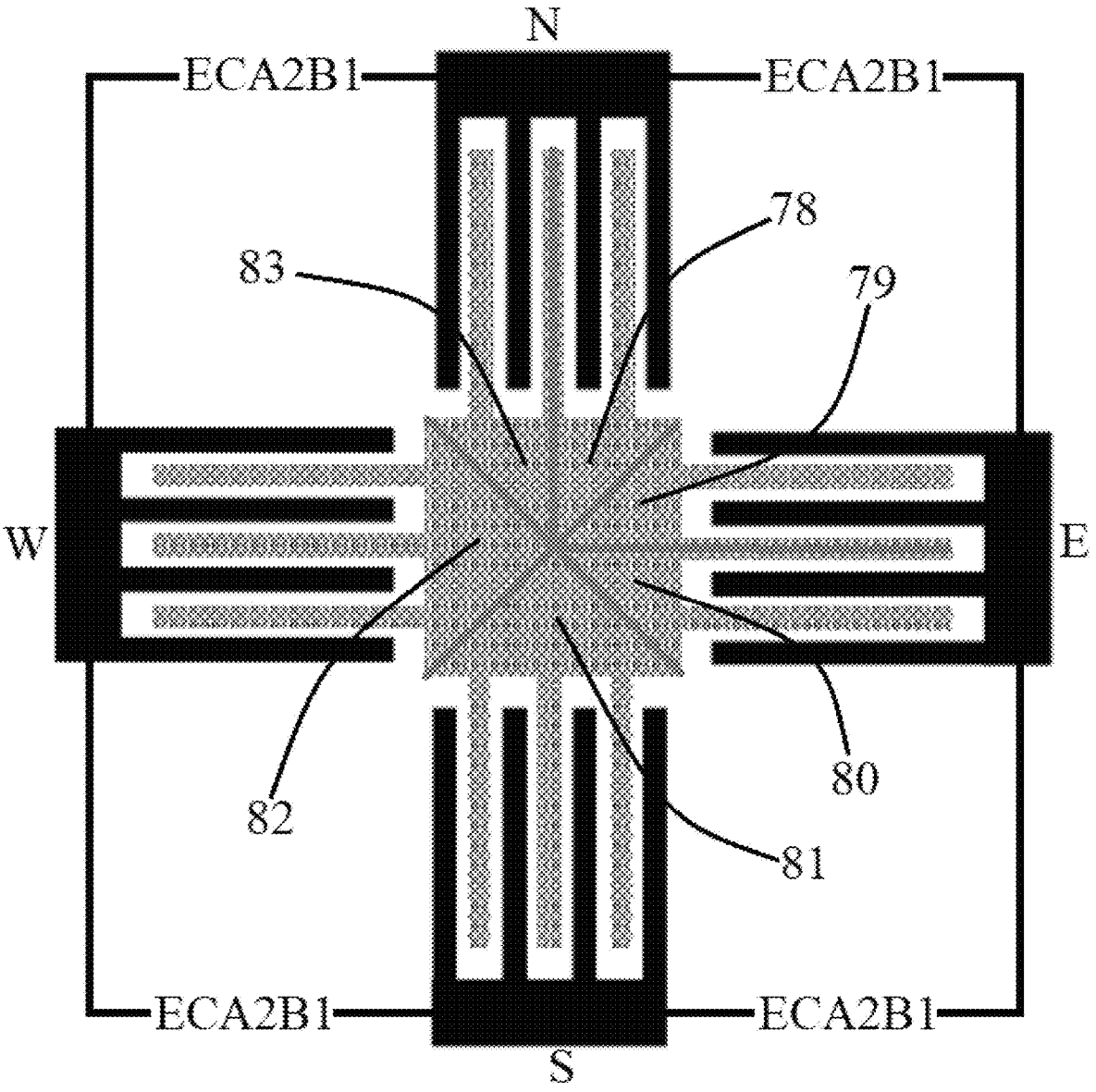
FIG. 28 is the top view of an eighth specific example of the general configuration as shown in FIG. 20 in accordance with an exemplary embodiment of the present invention.

As shown in FIG. 28, an electrical insulator 63 along both full diagonal lines, a half of the vertical middle line, and a half of the horizontal middle line of the square-shaped membrane of composite conductor ECA1B2 can generate six sub-conductors 78, 79, 80, 81, 82 and 83. Sub-conductors 81, 80 and 78 may be electrically connected and they together constitute one of electrical conductors ECA1 and ECB2, and the rest 3 sub-conductors may be electrically connected and they together constitute another one of electrical conductors ECA1 and ECB2. Alternatively, sub-conductors 81, 80 and 83 may be electrically connected and they together constitute one of electrical conductors ECA1 and ECB2, and the rest 3 sub-conductors may be electrically connected and they together constitute another one of electrical conductors ECA1 and ECB2. Alternatively, sub-conductors 81, 79 and 83 may be electrically connected and they together constitute one of electrical conductors ECA1 and ECB2, and the rest 3 sub-conductors may be electrically connected and they together constitute another one of electrical conductors ECA1 and ECB2. Alternatively, sub-conductors 81, 79 and 78 may be electrically connected and they together constitute one of electrical conductors ECA1 and ECB2; and the rest 3 sub-conductors may be electrically connected and they together constitute another one of electrical conductors ECA1 and ECB2.

Figure 29:
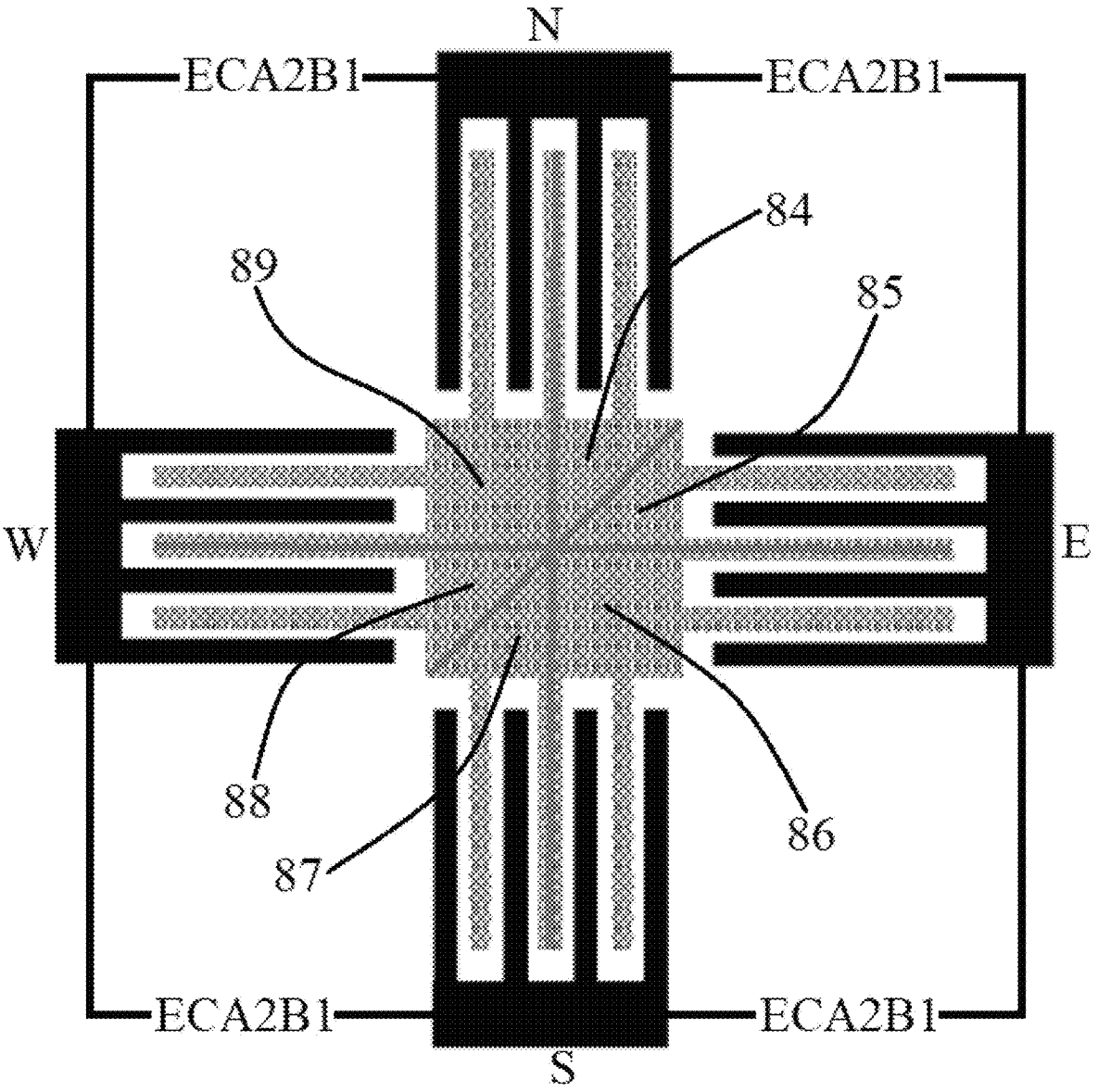
FIG. 29 is the top view of a ninth specific example of the general configuration as shown in FIG. 20 in accordance with an exemplary embodiment of the present invention.

As shown in FIG. 29, an electrical insulator 63 along the full "forward" diagonal line, the full vertical middle line, and the full horizontal middle line of the square-shaped membrane of composite conductor ECA1B2 can generate six sub-conductors 84-89. Sub-conductors 86, 87 and 84 may be electrically connected and they together constitute one of electrical conductors ECA1 and ECB2; and the rest 3 sub-conductors may be electrically connected and they together constitute another one of electrical conductors ECA1 and ECB2. Alternatively, sub-conductors 86, 85 and 88 may be electrically connected and they together constitute one of electrical conductors ECA1 and 1ECB2, and the rest 3 sub-conductors may be electrically connected and they together constitute another one of electrical conductors ECA1 and ECB2. An electrical insulator 63 along the full "backward" diagonal line, the full vertical middle line, and the full horizontal middle line will generate similar sub-conductor combinations, which will be omitted here.

Figure 30:
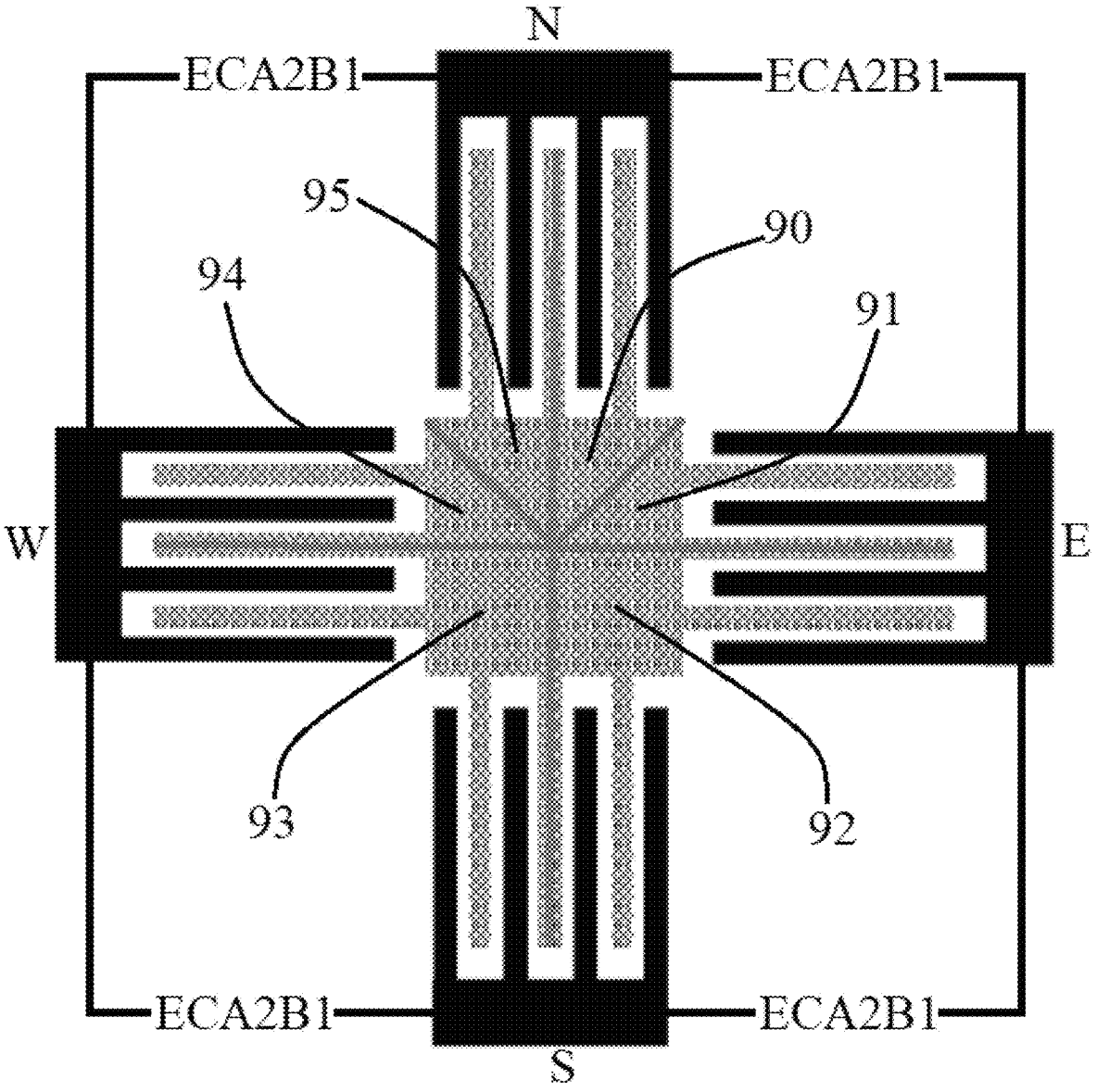
FIG. 30 is the top view of a tenth specific example of the general configuration as shown in FIG. 20 in accordance with an exemplary embodiment of the present invention

As shown in FIG. 30, an electrical insulator 63 along a half of the "forward" diagonal line, a half of the "backward" diagonal line, the full vertical middle line, and the full horizontal middle line of the square-shaped membrane of composite conductor ECA1B2 can generate six sub-conductors 90-95. Sub-conductors 92, 91 and 94 may be electrically connected and they together constitute one of electrical conductors ECA1 and ECB2; and the rest 3 sub-conductors may be electrically connected and they together constitute another one of electrical conductors ECA1 and ECB2. Alternatively, sub-conductors 92, 91 and 95 may be electrically connected and they together constitute one of electrical conductors ECA1 and ECB2; and the rest 3 sub-conductors may be electrically connected and they together constitute another one of electrical conductors ECA1 and ECB2. Alternatively, sub-conductors 92, 90 and 94 may be electrically connected and they together constitute one of electrical conductors ECA1 and ECB2; and the rest 3 sub-conductors may be electrically connected and they together constitute another one of electrical conductors ECA1 and ECB2. Alternatively, sub-conductors 92, 90 and 95 may be electrically connected and they together constitute one of electrical conductors ECA1 and ECB2; and the rest 3 sub-conductors may be electrically connected and they together constitute another one of electrical conductors ECA1 and ECB2.

Figure 31:
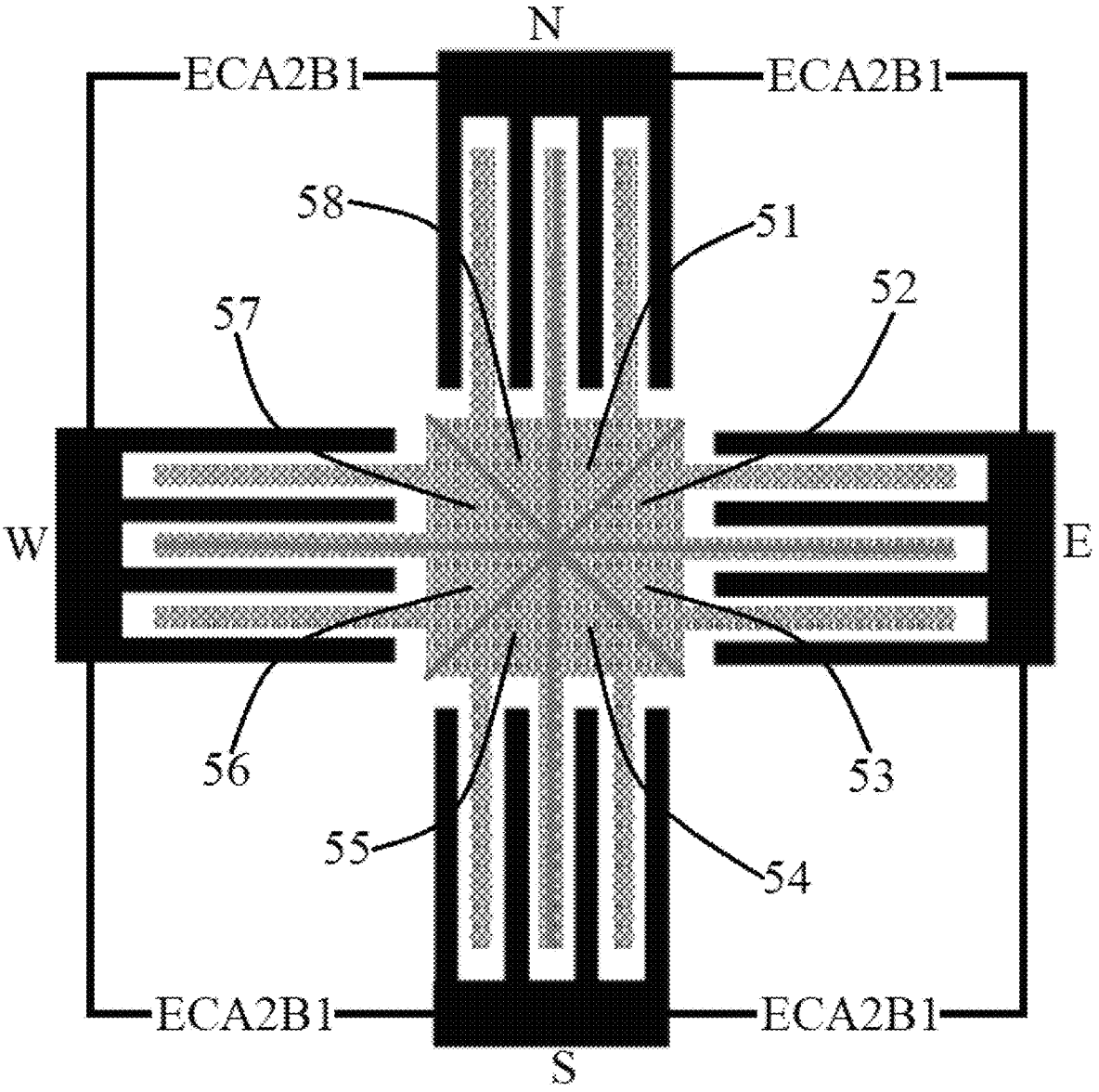
FIG. 31 is the top view of an eleventh specific example of the general configuration as shown in FIG. 20 in accordance with an exemplary embodiment of the present invention.

As shown in FIG. 31, an electrical insulator 63 along the full "forward" diagonal line, the full "backward" diagonal line, the full vertical middle line, and the full horizontal middle line of the square-shaped membrane of composite conductor ECA1B2 can generate eight sub-conductors 51-58. In theory, any four of sub-conductors 51-58 may be electrically connected and they together constitute one of electrical conductors ECA1 and ECB2; and the rest 4 sub-conductors may be electrically connected and they together constitute another one of electrical conductors ECA1 and ECB2. In preferred embodiments, sub-conductors 51, 53, 55 and 57 may be electrically connected and they together constitute one of electrical conductors ECA1 and ECB2, and the rest 4 sub-conductors 52, 54, 56 and 68 may be electrically connected and they together constitute another one of electrical conductors ECA1 and ECB2.

Figure 32:
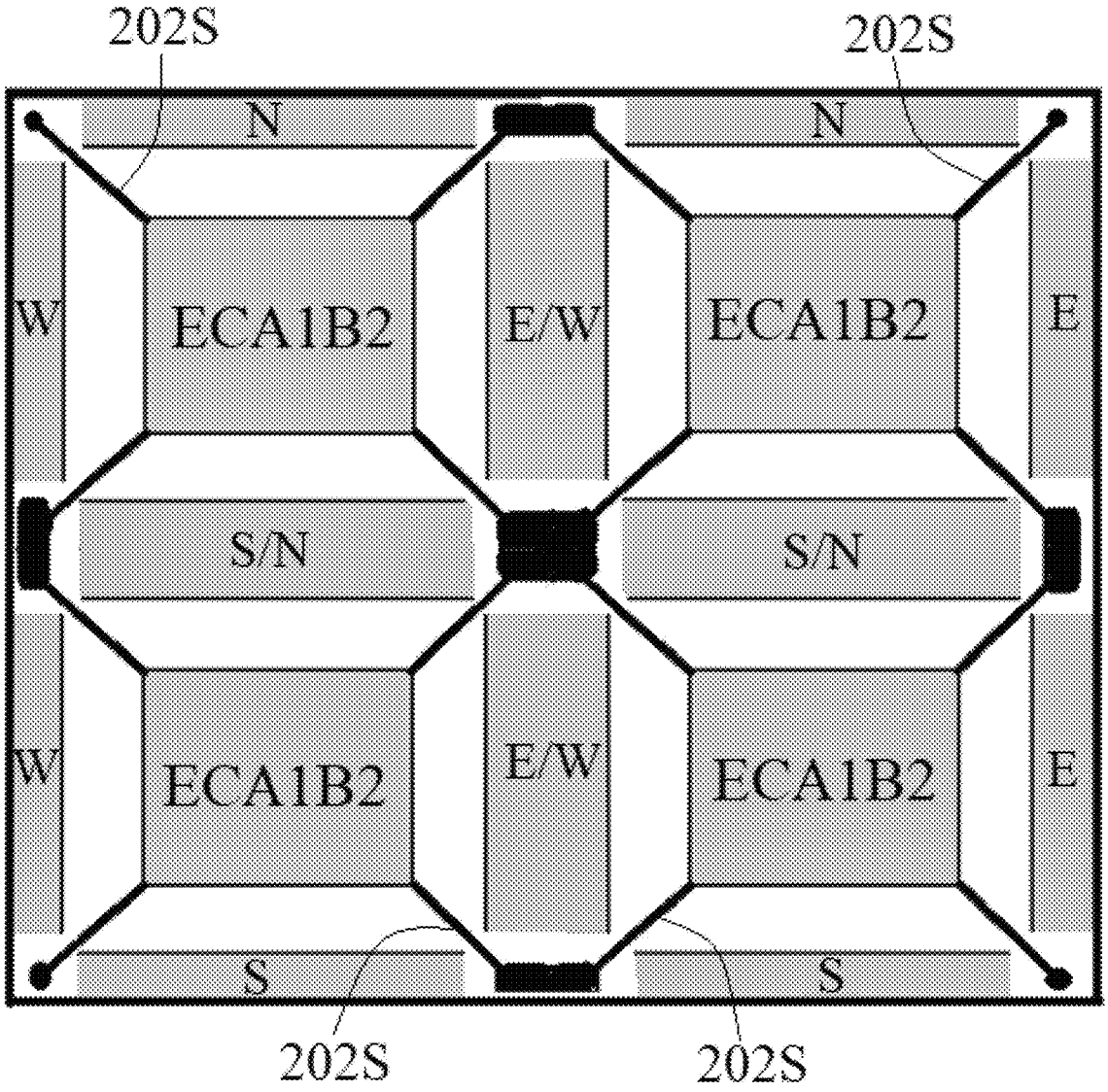
FIG. 32 shows that four movable composite conductors as shown in FIGS. 20-31 are arranged in a 2×2 array configuration in accordance with an exemplary embodiment of the present invention.

The capacitive microphone of the invention may include one or more movable membranes of composite conductor ECA1B2 For example, four movable membranes of composite conductor ECA1132 can be arranged in a 2×2 array configuration. As shown in FIG. 32, four movable composite conductors as shown in FIGS. 20-31 may be arranged in a 2×2 array configuration.

Figure 33:
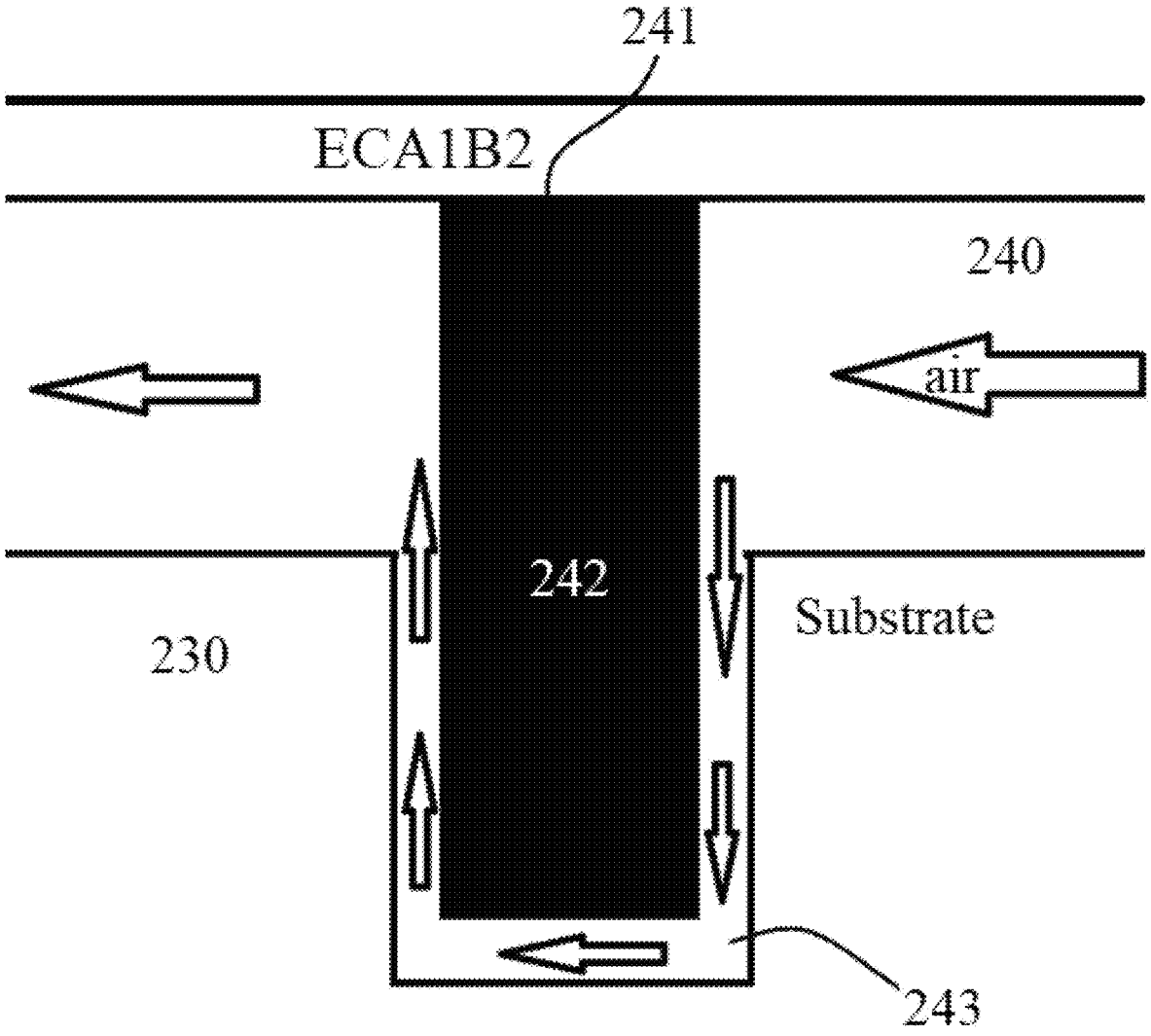
FIG. 33 demonstrates the design of one air flow restrictor between the substrate and the movable composite conductors as shown in FIGS. 20-31 in accordance with an exemplary embodiment of the present invention.
Figure 34:
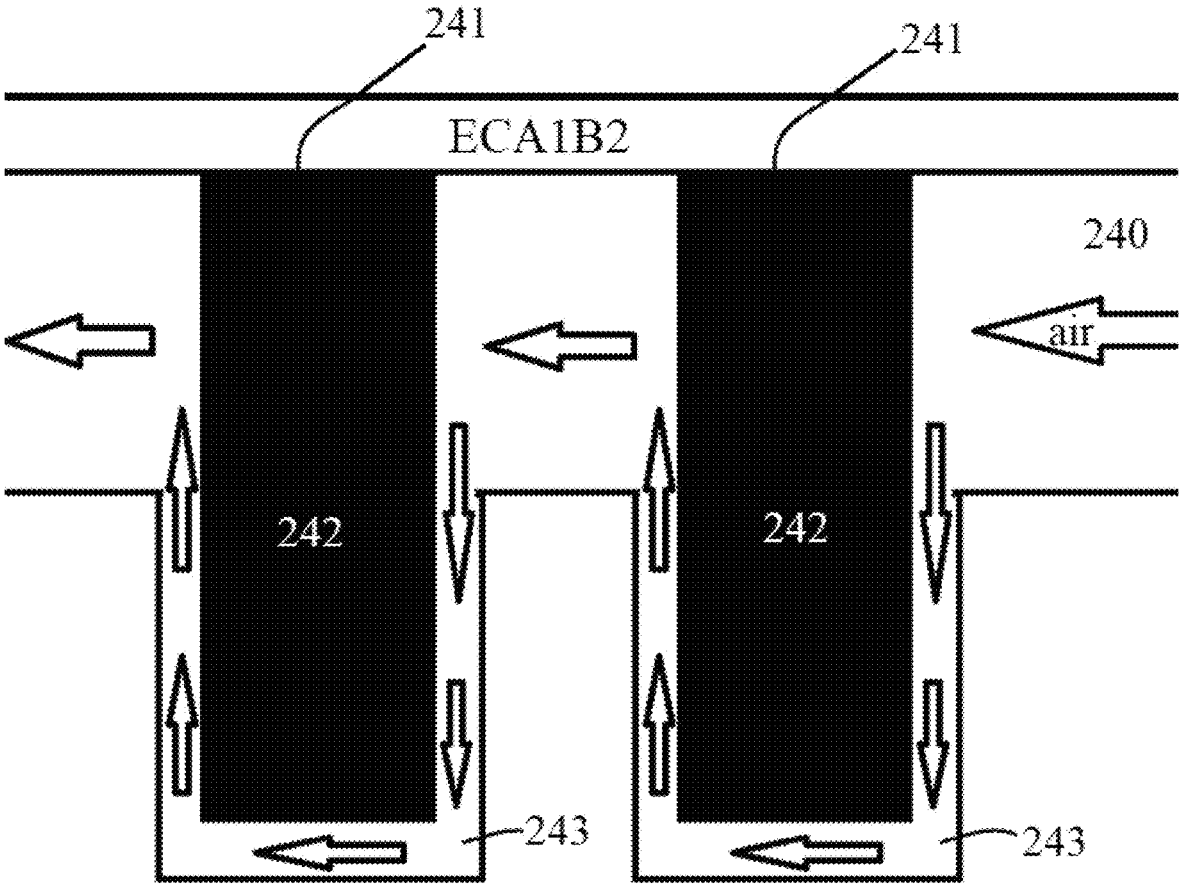
FIG. 34 demonstrates the design of two serial and co-centered flow restrictors between the substrate and the movable composite conductors as shown in FIGS. 20-31 in accordance with an exemplary embodiment of the present invention.

Leakage is often an issue in microphone design. In conventional parallel plate design as shown in FIG. 1A, it typically has a couple of tiny holes around the edge in order to let air go through slowly, to keep air pressure balance on both sides of membrane 101 in low frequency. That is a desired leakage. However, a large leakage is undesired, because it will let some low frequency sound wave escape away from membrane vibration easily via the holes; and will result in a sensitivity drop in low frequency. In some embodiments as shown in FIGS. 33 and 34, the capacitive microphone of the invention comprises one, two or more air flow restrictors 241 that restrict the flow rate of air that flows in/out of the gap between the membrane 202 of composite conductor ECA1B2 and the substrate 230. Air flow restrictors 241 may be designed to decrease the size of an air channel 240 for the air to flow in/out of the gap. Alternatively or additionally, air flow restrictors 241 may increase the length of the air channel 240 for the air to flow in/out of the gap. For example, air flow restrictors 241 may comprise an insert 242 into a groove 243, which not only decreases the size of an air channel 240, but also increases the length of the air channel 240. Air flow restrictors 241 may function as a structure for preventing air leakage in the microphone of the invention. In MEMS microphones, a deep slot may be etched on substrate around the edge of square membrane of composite conductor ECA1B2. Then, an insert/wall 242 connected to (or extended from) the square membrane is deposited to form a long and narrow air tube 240, which gives a large acoustic resistance.

In various exemplary embodiments, the capacitive microphone of the invention is a MEMS microphone, in which conductors ECA1, ECA2, ECB1 and ECB2 are independently of each other made of polysilicon, gold, silver, nickel, aluminum, copper, chromium, titanium, tungsten, or platinum. Fabrication of the capacitive microphone can be carried out using any methods known in the technical field of micro-electromechanical system (MEMS).

In the foregoing specification, embodiments of the present invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicant to be the scope of the invention, is the literal and equivalent scope of the set of claims that issue from this application, in the specific form in which such claims issue, including any subsequent correction.

The invention claimed is:

1. A capacitive microphone comprising a first capacitor and a second capacitor; wherein a signal output S1 of the first capacitor is substantially (±5%) the additive inverse of a signal output S2 of the second capacitor, and a total signal output St is a difference between S1 and S2; and wherein the first capacitor comprises a first electrical conductor ECA1 and a second electrical conductor ECA2 that are configured in a lateral mode as defined in the following: wherein conductors ECA1 and ECA2 have a mutual capacitance therebetween; wherein said mutual capacitance can be varied by an acoustic pressure impacting upon ECA1 and/or ECA2 along a range of impacting directions in 3D space, generating the signal output S1 of the first capacitor; wherein said mutual capacitance is varied the most by an acoustic pressure impacting upon ECA1 and/or ECA2 along one direction among said range of impacting directions, said one direction being defined as the primary direction; wherein ECA1 has a first projection along said primary direction on a conceptual plane that is perpendicular to said primary direction; and ECA2 has a second projection along said primary direction on the conceptual plane; wherein the first projection and the second projection have a shortest distance Dmin therebetween, and Dmin remains greater than zero regardless of that ECA 1 and/or ECA2 is (are) impacted by an acoustic pressure along said primary direction or not; wherein the second capacitor comprises a third electrical conductor ECB1 and a fourth electrical conductor ECB2 that are also configured in a lateral mode: wherein the first capacitor and the second capacitor share a same primary direction: wherein the capacitive microphone further comprises a substrate, wherein the substrate can be viewed as said conceptual plane, wherein conductors ECA1 and ECA2 are constructed above the substrate side-by-side, and wherein conductors ECB1 and ECB2 are also constructed above the substrate side-by-side; wherein one of conductors ECA1 and ECA2 is electrically connected to one of conductors ECB1 and ECB2 to form a single shared conductor ECA2B1; wherein single conductor ECA2B1 is fixed relative to the substrate, conductors ECA1 and ECB2 are electrically separated but physically combined into a composite conductor ECA1B2 comprising a membrane that is movable relative to the substrate, and said primary direction is perpendicular to the membrane plane; wherein conductor ECA1 in the composite conductor ECA1B2 comprises a flat layer in parallel to the substrate and having a thickness ECA1t and a height ECA1h along the primary direction as measured from the substrate; wherein conductor ECB2 in the composite conductor ECA1B2 comprises a flat layer in parallel to the substrate and having a thickness ECB2t and a height ECB2h along the primary direction as measured from the same substrate; wherein single conductor ECA2B1 comprises a portion ECA2* facing conductor ECA1, and portion ECA2* comprises a flat layer in parallel to the substrate and having a thickness ECA2*t and a height ECA2*h along the primary direction as measured from the same substrate; and wherein single conductor ECA2B1 comprises a portion ECB1* facing conductor ECB2, and portion ECB1* comprises a flat layer in parallel to the substrate and having a thickness ECB1*t and a height ECB1*h along the primary direction as measured from the same substrate.

2. The capacitive microphone according to claim 1, wherein a noise of the signal output S1 partially or completely cancels off a noise of the signal output S2, when the total signal output St is generated.

3. The capacitive microphone according to claim 1, wherein thickness ECA1t and thickness ECA2*t are and/or wherein thickness ECB2t and thickness ECB1*t are equal.

4. The capacitive microphone according to claim 1, wherein thickness ECA1t, thickness ECA2*t, thickness ECB2t, and thickness ECB1*t are the same, and are equal to ABt.

5. The capacitive microphone according to claim 4, wherein height difference ΔAh is defined as height ECA2*h minus height ECA1h; wherein height difference ΔBh is defined as height ECB2h minus height ECB1*h; ΔAh≠0, ΔBh≠0, and ΔAh=ΔBh.

6. The capacitive microphone according to claim 5, wherein the absolute values of ΔAh and ΔBh are about one third of ABt, |ΔAh|≤1/3ABt.

7. The capacitive microphone according to claim 5, wherein height ECA1h=height ECB2h.

8. The capacitive microphone according to claim 5, wherein height ECA2*h=height ECB1*h.

9. The capacitive microphone according to claim 5, wherein portion ECA2* of single conductor ECA2B1 comprises a set of comb fingers ECA2*f, wherein portion ECB1* of single conductor ECA2B1 comprises a set of comb fingers ECB1*f, wherein the movable membrane of composite conductor ECA1B2 comprises a set of comb fingers ECA1B2f around the peripheral region of the membrane, and wherein comb fingers ECA2*f and comb fingers ECB1*f are interleaved into comb fingers ECA1B2f.

10. The capacitive microphone according to claim 9, wherein comb fingers ECA1B2f are laterally movable relative to both comb fingers ECA2*f and comb fingers ECB1*f, and the resistance from air located within a gap between the membrane and the substrate is lowered.

11. The capacitive microphone according to claim 10, wherein comb fingers ECA1B2f, comb fingers ECA2*f, and comb fingers ECB1*f have identical shape and dimension.

12. The capacitive microphone according to claim 1, wherein the movable membrane is attached to the substrate via three or more suspensions; and each suspension comprises folded and symmetrical cantilevers.

13. The capacitive microphone according to claim 1, wherein the movable membrane is square shaped.

14. The capacitive microphone according to claim 13, which comprises one, two or more said movable membranes, or four movable membranes arranged in a 2×2 array configuration.

* * * * *